US007913778B2

(12) United States Patent
Tedeschi et al.

(10) Patent No.: US 7,913,778 B2
(45) Date of Patent: Mar. 29, 2011

(54) ROCK BIT WITH HYDRAULIC CONFIGURATION

(75) Inventors: Luca Tedeschi, Volterra (IT); James L. Larsen, Spring, TX (US); Gary Portwood, Florence (IT); Riccardo Gronchi, Certaldo (IT)

(73) Assignee: Smith International, Inc., Houston, TX (US)

( * ) Notice: Subject to any disclaimer, the term of this patent is extended or adjusted under 35 U.S.C. 154(b) by 176 days.

(21) Appl. No.: 12/179,989

(22) Filed: Jul. 25, 2008

(65) Prior Publication Data

US 2009/0095536 A1 Apr. 16, 2009

Related U.S. Application Data

(60) Provisional application No. 60/979,806, filed on Oct. 12, 2007, provisional application No. 61/038,888, filed on Mar. 24, 2008.

(51) Int. Cl.
*E21B 10/18* (2006.01)

(52) U.S. Cl. ..... 175/339; 175/341; 175/331

(58) Field of Classification Search ..... 175/331, 175/336, 339, 341, 378, 340, 355, 393
See application file for complete search history.

(56) References Cited

U.S. PATENT DOCUMENTS

| | | | | |
|---|---|---|---|---|
| 2,901,223 | A * | 8/1959 | Scott | 175/333 |
| 4,187,921 | A | 2/1980 | Garner | |
| 4,369,849 | A | 1/1983 | Parrish | |
| 4,611,673 | A | 9/1986 | Childers et al. | |
| 4,665,999 | A | 5/1987 | Shoemaker | |
| 4,741,406 | A | 5/1988 | Deane et al. | |
| 4,848,476 | A | 7/1989 | Deane et al. | |
| 4,984,643 | A | 1/1991 | Isbell et al. | |
| 5,538,093 | A | 7/1996 | Siracki et al. | |
| 5,601,153 | A | 2/1997 | Ensminger et al. | |
| 5,853,055 | A | 12/1998 | Siracki et al. | |
| 6,065,683 | A | 5/2000 | Akin et al. | |

(Continued)

FOREIGN PATENT DOCUMENTS

| | | |
|---|---|---|
| CA | 1182105 | 2/1985 |

(Continued)

OTHER PUBLICATIONS

Combined Search and Examination Report dated Feb. 23, 2009 for Appl. No. GB0818100.0; (pp. 7).

(Continued)

*Primary Examiner* — Kenneth Thompson
(74) *Attorney, Agent, or Firm* — Christie, Parker & Hale, LLP

(57) ABSTRACT

A drill bit for drilling through an earthen formation to form a borehole with a radius R. In an embodiment, the drill bit comprises a bit body having a central bit axis and including a pin end, an internal plenum, and a dome side. The dome side includes a central dome region extending from the bit axis to about 10% of the radius R and an intermediate dome region extending from the central region to about 50% of the radius R. In addition, the drill bit comprises an intermediate receptacle having a central axis and extending through the intermediate dome region. Further, the drill bit comprises a first and a second rolling cone, each including an intermediate cone region. A projection of the central axis of the intermediate receptacle passes between the intermediate regions of the first cone and the second cone.

36 Claims, 15 Drawing Sheets

U.S. PATENT DOCUMENTS

| | | | | |
|---|---|---|---|---|
| 6,098,728 | A | 8/2000 | Wells et al. | |
| 6,290,006 | B1 | 9/2001 | Crawford | |
| 6,311,793 | B1 | 11/2001 | Larsen et al. | |
| 6,354,387 | B1 * | 3/2002 | Harris et al. | 175/340 |
| 6,571,887 | B1 | 6/2003 | Nguyen et al. | |
| 6,585,063 | B2 | 7/2003 | Larsen | |
| 6,651,758 | B2 | 11/2003 | Xiang et al. | |
| 7,188,682 | B2 | 3/2007 | Larsen et al. | |
| 7,213,661 | B2 | 5/2007 | Larsen et al. | |
| 7,370,711 | B2 | 5/2008 | Singh | |
| 2005/0121235 | A1 | 6/2005 | Larsen et al. | |
| 2006/0054355 | A1 | 3/2006 | Larsen et al. | |
| 2007/0034411 | A1 | 2/2007 | Singh | |
| 2007/0163811 | A1 | 7/2007 | Gutmark et al. | |
| 2009/0159340 | A1 | 6/2009 | Tedeschi et al. | |

FOREIGN PATENT DOCUMENTS

| | | | |
|---|---|---|---|
| GB | 872076 | | 4/1960 |
| GB | 2408763 | | 6/2005 |
| GB | 2443115 | | 4/2008 |
| GB | 2454068 | B | 6/2010 |
| GB | 2461429 | B | 6/2010 |
| GB | 2461430 | B | 6/2010 |
| RU | 2019668 | | 9/1994 |
| RU | 2191244 | | 10/2002 |

OTHER PUBLICATIONS

Combined Search and Examination Report dated Oct. 29, 2009 for Appl. No. GB0916876.6 (6 p.).

Comined Search and Examination Report dated Oct. 29, 2009, for Appl. No. GB0916877.4 (8 p.).

Combined Search and Examination Report for Appl. No. 0818100.0 dated Dec. 21, 2009; (1 p.).

Response to Combined Search and Examination Report dated Dec. 21, 2009 for Appl. No. 0818100.0 (24 p.).

Response to Combined Search and Examination Report dated Oct. 29, 2009 for Appl. No. 0916876.6 (29 p.).

Response to Combined Search and Examination Report dated Oct. 29, 2009 for Appl. No. 0916877.4 (21 p.).

* cited by examiner

ROCK BIT WITH HYDRAULIC CONFIGURATION

CROSS-REFERENCE TO RELATED APPLICATIONS

This application claims benefit of U.S. provisional application Ser. No. 60/979,806 filed Oct. 12, 2007, and entitled "Rock Bit with Hydraulics Configuration," which is hereby incorporated herein by reference in its entirety. This application also claims benefit of U.S. provisional application Ser. No. 61/038,888 filed Mar. 24, 2008, and entitled "Rock Bit with Vectored Hydraulic Nozzle Retention Sleeves," which is hereby incorporated herein by reference in its entirety. This application also claims benefit of U.S. non-provisional application Ser. No. 12/104,856 filed Apr. 17, 2008, and entitled "Rock Bit With Vectored Hydraulic Nozzle Retention Sleeves," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The present invention relates generally to roller cone rock bits that operate in "drilling mud." More specifically, the invention relates to roller cone rock bits having nozzle arrangements configured to provide enhanced cutting structure cleaning while offering the potential to reduce cone erosion.

2. Background of the Invention

Rotary cone rock bits are used for drilling boreholes in various earth formations. Roller cone bits are conventionally manufactured using a segmented arc construction method. This method utilizes three 120° arcuate leg segments, each comprising one-third of the drill bit body and an individual leg portion with a bearing journal thereon. The three arcuate sections are usually forged and then machined to form the bearing surfaces on the bearing journals and the mating surfaces along each edge where the three sections are welded together. Prior to joining the three arcuate sections to form a bit body, the cutter assembly with bearings and retention means are mounted on the inwardly projecting bearing journals due to space limitations and associated difficulties of mounting the cutters after the three arcuate sections have been welded together. After the bearing assemblies and cutters are mounted on the machined bearing journals, the three leg segments are then placed in a welding jig and welded to each other to form the bit body. After welding has occurred a tapered thread is machined on the upper end of the bit, commonly referred to as the "pin" end, and the bit is ready for use.

To aid in the removal of drilling cuttings from the bottom of the borehole, mud or other fluids are introduced to the bottom of the borehole through nozzles or jet assemblies positioned in bores formed in the bit body. The fluid or mud pumped through the bit body also serves to remove heat from the rock bit. In general, as the efficiency of the cutting removal is increased, the cutting efficiency and associated rate of penetration (ROP) are also increased.

To efficiently remove cuttings from the borehole, the fluid or mud must carry the cuttings radially outward on the borehole bottom and then upward through the annulus (i.e., the annular space formed between the bit body and drill string, and the borehole). A fluid flow that will carry the cuttings radially outward from the center of the borehole and up the annulus may be created by introducing a downward fluid flow on the cutting structure of the bit. As the fluid flows past the cutting structure, the fluid impacts the borehole bottom and spreads radially outward to the annulus.

The amount of energy available at the bit is generally dictated by factors external to the bit such as the drilling rigs' available hydraulic energy, drill pipe type, bottom hole assembly (BHA) configuration and drill depth. However, once the available energy for the rock bit is determined, properly configuring the hydraulics of the bit for the specific application can significantly affect the rate of penetration (ROP) of the bit in the formation.

When drilling softer formations and plastic formations, there is a strong tendency for cuttings to adhere to the teeth or inserts of bits. The adhesion of formation to teeth or inserts is commonly referred to as "bit balling". As is known in the art, bit balling describes the packing of formation between the cones and bit body, or between the cutting elements on the bit, during drilling. When bit balling occurs, the cutting elements may be sufficiently packed off such that they are limited in their ability to effectively penetrate into the formation, thereby tending to slow the ROP of the drill bit. Thus, cuttings must be removed efficiently during drilling to maintain reasonable penetration rates.

In harder clays and shales, cuttings can become impacted or "balled up" between the teeth or inserts of the cutting structures. When formation sticks to cones or is impacted between cutting elements it limits the ability of the cutting element to penetrate the formation. Also, formation packed against the cone-shell constricts the flow channels needed to carry cuttings away. This promotes premature bit wear. In either instance, having sufficient drilling fluid directed toward the cones can help to clean the inserts and cones, allowing them to penetrate to a greater depth, thus maintaining the ROP of the bit. Furthermore, bit durability may be improved, even as the inserts begin to wear down since the cleaned inserts will continue to penetrate the formation even in their reduced state.

To combat bit balling and to allow for larger cones, the cutting elements on adjacent rolling cones are often arranged to intermesh. As a cutting element of a first cone intermeshes between two rows of cutting elements of a second cone, it dislodges formation packed between the two rows of cutting elements. Having the cutting elements intermesh also allows the diameter of the cones to be larger, providing for a larger bearing surface which results in a more durable cone.

To further facilitate cuttings removal, jets or nozzles are positioned on the bit to wash cuttings from the cutting structure and/or borehole bottom. Conventional nozzle arrangements include the placement of a nozzle between each of the cones proximal the outer periphery of the bit. In many applications, a jet may also be located at the center of the bit to channel fluid flow directly to the borehole bottom. For example, U.S. Pat. No. 5,853,055 describes an extended center jet on a bit to reduce diffusion and provide a substantially uninterrupted fluid flow that strikes the borehole bottom with maximum impact energy. U.S. Pat. No. 6,290,006 describes special nozzles that can be used to provide collimated streams of high velocity drilling fluid that strike different areas of the bottomhole with maximum energy for enhanced bottomhole cleaning. An alternative nozzle arrangement involves a jet positioned between each of the cones near the periphery of the bit body. U.S. Pat. No. 4,611,673 proposes orienting nozzles toward one of the adjacent cones so that the jet of fluid exiting the nozzle will strike the cutting elements on the cone. However, these arrangements may not be desirable in applications where bit balling is a concern because they do not provide cleaning along interior rows of cutting elements on the cones, and further, a concentrated flow of drilling fluid directed toward and impacting a cone shell may result in excessive erosion of the cones and premature loss of cutting elements from the cones.

To avoid balling problems, bits have been designed with additional nozzles positioned over each of the cones which direct a jet stream of fluid directly on top of the cones in the dome region. One problem with these designs is that the impact of fluid directly on top of the cones often results in severe erosion of the cone shell and a premature loss of cutting elements from the cones. The placement of these nozzles has been restricted in the prior art to nozzle bores where the nozzles are installed through the pin due to limited access to the dome region from the journal side of the forging to drill the required nozzle bores.

In the prior art, a cast bit body was proposed that allowed for the machining and installation of nozzles before the leg portions were attached to the body. Unfortunately, the method requires a cast body formed separately from the leg portions. In practice, this type of cast body method is not typically used, and is generally limited to the manufacture of extremely large bits. Further, these designs may require insertion of the nozzles in the bit body prior to assembly of the legs on the bit. In practice, nozzles are typically inserted in the field after assembly of the bit based on rig specifications and drilling requirements particular to a specific application.

Numerous efforts have been made by drill bit designers to solve the problem of bit balling yet the problem persists. Accordingly, there is a need in the art for bits having an improved nozzle configuration that provides sufficient cleaning for cutting elements along the inner rows and outer rows of the cones to minimize bit balling. Such bits with improved nozzle configurations would be particularly well received if they reduced impingement of the cone shell with drilling fluid, thereby offering the potential to reduce the likelihood of cone shell erosion and associated premature loss of cutting elements.

BRIEF SUMMARY OF SOME OF THE PREFERRED EMBODIMENTS

These and other needs in the art are addressed in one embodiment by a drill bit for drilling through an earthen formation to form a borehole with a radius R, a bottom and a sidewall, the drill bit having a full gage diameter with the radius R. In an embodiment, the drill bit comprises a bit body having a central bit axis and including a pin end, an internal plenum, and a dome side generally opposite the pin end. The dome side includes a central dome region extending from the bit axis to about 10% of the radius R, an annular intermediate dome region extending from the central region to about 50% of the radius R, and an annular outer dome region extending from the intermediate region to about 90% of the radius R. In addition, the drill bit comprises an intermediate receptacle having a central axis and extending through the intermediate dome region to the plenum. Further, the drill bit comprises a first and a second rolling cone, each cone being mounted to the bit body and adapted for rotation about a different cone axis. Each cone comprises a nose proximal the bit axis, a generally planar backface distal the bit axis, an inner cone region extending axially relative to the cone axis from the nose to an intermediate cone region, and an outer cone region extending axially relative to the cone axis from the backface to the intermediate region. A plurality of cutting elements are mounted to the inner region, the intermediate region, and the outer region of each cone, wherein the cutting elements mounted to the inner cone region of each cone are positioned to contact the borehole bottom between the bit axis and about 25% of the radius R, the cutting elements mounted to the intermediate cone region of each cone are positioned to contact the borehole bottom between about 25% and 75% of the radius R, and the cutting elements mounted to the outer cone region of each cone are positioned to contact the borehole bottom between about 75% and 100% of the radius R. Moreover, wherein a projection of the central axis passes between the intermediate region of the first cone and the intermediate region of the second cone.

Theses and other needs in the art are addressed in another embodiment by a drill bit for drilling through an earthen formation to form a borehole with a radius R, a bottom and a sidewall, the drill bit having a full gage diameter with the radius R. In an embodiment, the drill bit comprises a bit body having a central bit axis and including a pin end, an internal plenum, a dome side generally opposite the pin end, a first leg, and a second leg circumferentially spaced from the first leg, each leg including a journal. The dome side includes a central dome region extending from the bit axis to about 10% of the radius R, an annular intermediate dome region extending from the central region to about 50% of the radius R, and an annular outer dome region extending from the intermediate region to about 90% of the radius R. In addition, the drill bit comprises an intermediate receptacle having a central axis and extending through the intermediate dome region to the plenum. Further, the drill bit comprises a first rolling cone mounted to the journal of the first leg and adapted for rotation about a first cone axis. Still further, the drill bit comprises a second rolling cone mounted to the journal of the second leg and adapted for rotation about a second cone axis. A reference plane parallel to and passing through the bit axis is positioned at the circumferential midpoint between the first leg and the second leg. A first boundary plane parallel to and passing through the bit axis is oriented at a boundary angle $\beta_1$ relative to the reference plane. A second boundary plane parallel to and passing through the bit axis is oriented at a boundary angle $\beta_2$ relative to the reference plane. The first boundary plane and the second boundary plane are disposed on opposite sides of the reference plane. The first boundary angle $\beta_1$ and the second boundary angle $\beta_2$ are each less than 30°. Moreover, a projection of the central axis of the intermediate receptacle is circumferentially bounded by the first boundary plane and the second boundary plane between the dome side and the borehole bottom.

Theses and other needs in the art are addressed in another embodiment by a drill bit for drilling an earthen formation to form a borehole with a radius R. In an embodiment, the drill bit comprises a bit body having a central axis and a dome side. The dome side includes a central dome region extending from the bit axis to about 10% of the radius R, an annular intermediate dome region extending from the central region to about 50% of the radius R, and an annular outer dome region extending from the intermediate region to about 90% of the radius R. In addition, the drill bit comprises a plurality of rolling cones, each of the cone cutters being mounted to the bit body and adapted for rotation about a different cone axis. Further, the drill bit comprises a plurality of intermeshing cutting elements mounted to each of the cones. Still further, the drill bit comprises a plurality of intermediate receptacles in the bit body. Each intermediate receptacle has a central axis and extends through the intermediate dome region to the plenum. One intermediate receptacle is circumferentially positioned between the cone axes of each pair of adjacent cones. Moreover, a projection of the central axis of each intermediate receptacle passes through the intermeshing cutting elements between each pair of adjacent cone cutters.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
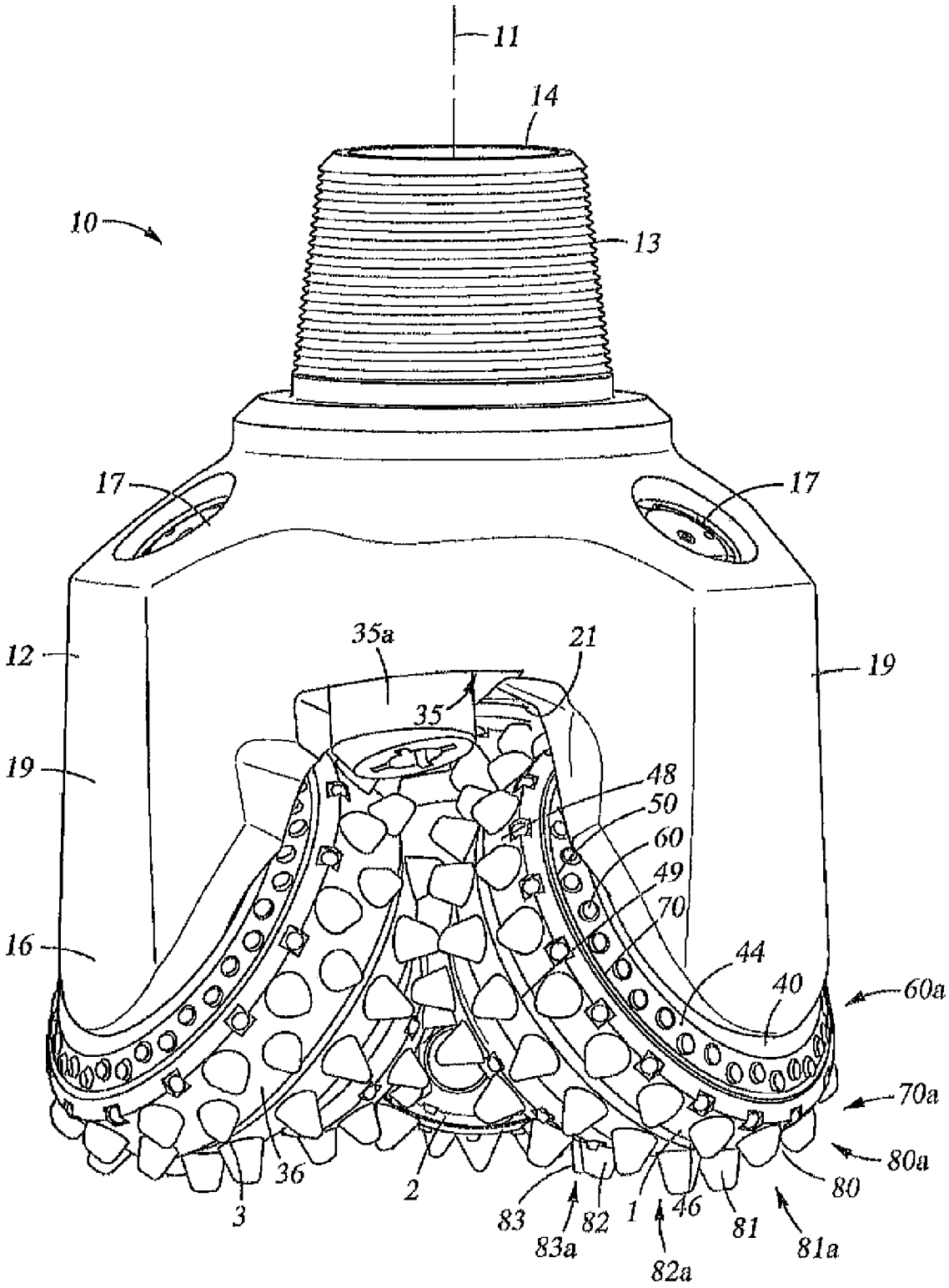
FIG. 1 is a perspective view of an embodiment of an earth-boring bit made in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing Figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring first to FIG. 1, an embodiment of an earth-boring bit 10 made in accordance with the principles described herein is shown. Bit 10 includes a central axis 11 and a bit body 12 having a threaded section 13 at its upper or pin end 14 that is adapted for securing the bit 10 to a drill string (not shown). Bit 10 has a predetermined gage diameter, defined by the outermost reaches of three rolling cone cutters 1, 2, 3 which are rotatably mounted on bearing shafts that depend from the bit body 12. Bit body 12 is composed of three sections or legs 19 that are welded together to form bit body 12. The surface of bit body 12 extending between legs 19 and facing the borehole bottom is generally referred to as the underside or dome 21 of bit 10. As will be described in more detail below, bit 10 further includes a plurality of sleeve receptacles, each with a nozzle retention sleeve disposed therein. The nozzle retention sleeves are each adapted to receive a drilling fluid jet or nozzle. In FIG. 1, one sleeve receptacle 35 including a nozzle retention sleeve **35*a* is shown. In general, the nozzle retention sleeves and nozzles disposed therein direct drilling fluid around cutters 1-3 and toward the bottom of the borehole. Although bit 10 shown in FIG. 1 includes three rolling cone cutters 1, 2, 3**, in other embodiments, the bit may include one, two, or more cone cutters.

Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter.

Figure 2:
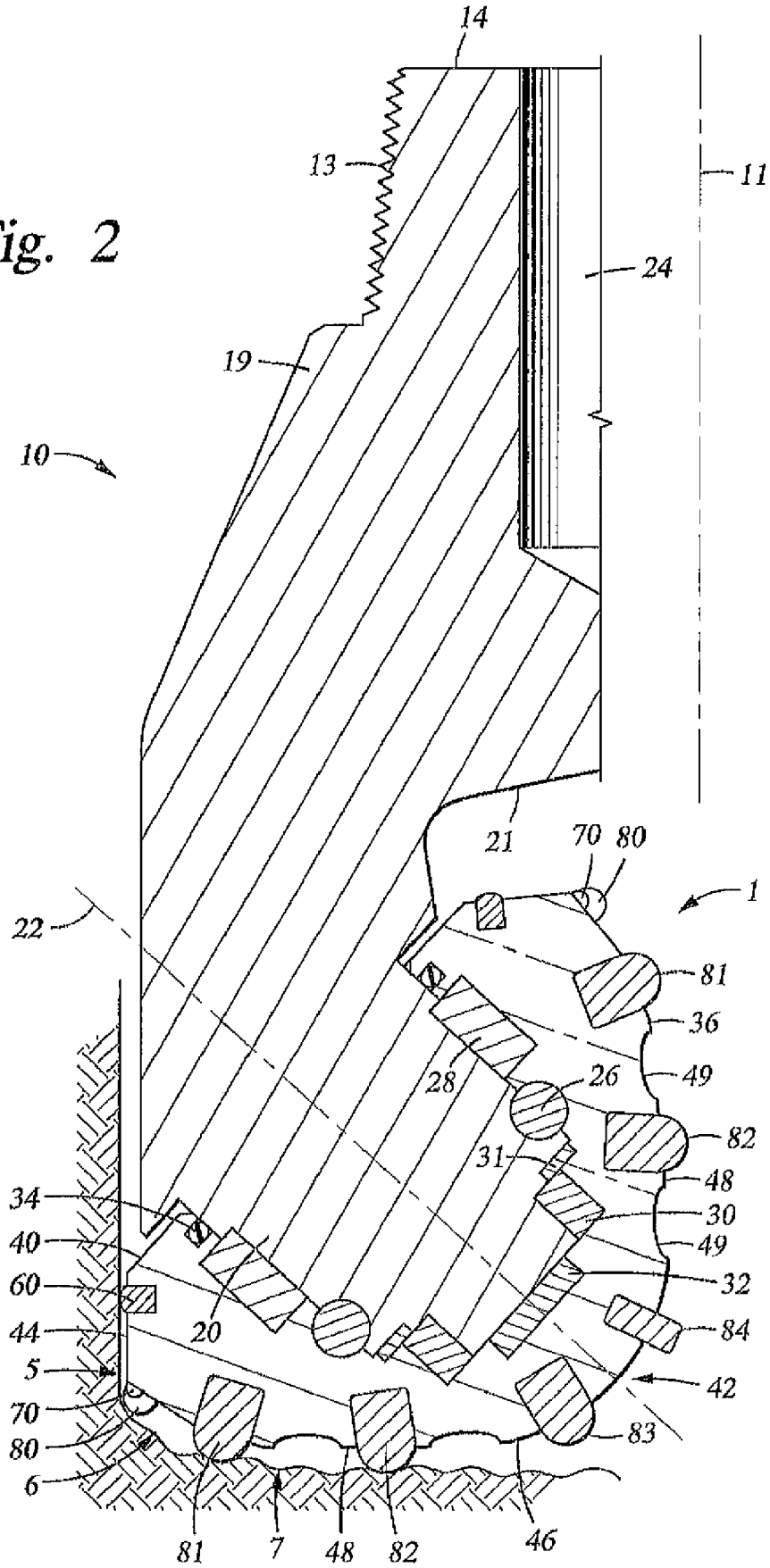
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial thrust and axial thrust are absorbed by journal sleeve 28 and thrust washer 31. The bearing structure shown is generally referred to as a journal bearing or friction bearing; however, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. In other embodiments, an open bearing bit design in which the bearings are not sealed may be employed.

As best shown in FIG. 2, bit body 12 includes an interior fluid passage or plenum 24 which acts as a conduit for drilling fluid. In particular, drilling fluid is pumped from the surface through the drill string to fluid passage 24 where it is circulated through an internal passageway (not shown) to the receptacles and the nozzles disposed therein. The borehole created by bit 10 includes sidewall 5, corner portion 6 and bottom 7.

Referring still to FIGS. 1 and 2, each rolling cone cutter 1-3 includes a cone shell 36 and a plurality of cutting elements mounted to cone shell 36. Each cone shell 36 includes a generally planar backface 40 and nose 42 generally opposite backface 40. Adjacent to backface 40, each cone shell 36 further include a generally frustoconical surface 44 that is adapted to retain cutting elements that scrape or ream the sidewalls of the borehole as the cone cutters 1-3 rotate about the borehole bottom. Frustoconical surface 44 will be referred to herein as the "heel" surface of cone cutters 1-3.

Extending between heel surface 44 and nose 42 is a generally conical cone surface 46 adapted for supporting cutting elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions 48, generally referred to as "lands", which are employed to support and secure the cutting elements as described in more detail below. Grooves 49 are formed in cone surface 46 between adjacent lands 48.

In the bit shown in FIGS. 1 and 2, each cone cutter 1-3 includes a plurality of wear resistant cutting elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of nestled gage inserts 70 secured to cone cutter 1 in locations along or near the circumferential shoulder 50. Relieved areas or lands 78 (best shown in FIG. 1) are formed about nestled gage inserts 70 to assist in mounting inserts 70. Additionally, the cone cutter includes a second circumferential row 80*a* of gage inserts 80. The cutting surfaces of inserts 70, 80 have differing geometries, but each extend to full gage diameter. The cone cutter 1 further includes inner row inserts 81, 82, 83 secured to cone surface 46 and arranged in concentric, spaced-apart inner rows 81*a*, 82*a*, 83*a*, respectively.

Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action of gage inserts 80 thereby preventing gage inserts 80 from wearing as rapidly as might otherwise occur. Inner row cutter elements 81, 82, 83 of inner rows 81*a*, 82*a*, 83*a* are employed to gouge and remove formation material from the remainder of the borehole bottom 7, and thus, may also be referred to here in as "bottomhole" cutting elements.

Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs between the three cones in order to maximize borehole bottom coverage, and also to provide clearance for the cutter elements on the adjacent cone cutters.

In the embodiment shown, inserts 60, 70, 80-83 each includes a generally cylindrical base portion, a central axis, and a cutting portion that extends from the base portion, and further includes a cutting surface for cutting the formation material. The base portion is secured by interference fit into a mating socket drilled into the surface of the cone cutter. In general, the cutting surface of an insert refers to the surface of the insert that extends beyond the surface of the cone cutter.

As shown in FIG. 1, bottomhole cutter elements 62 are arranged on the conical surfaces 46 of cone cutters 1-3 so as to "intermesh" between adjacent cones. The term "intermesh" is well known in the art and can generally be defined as the overlap of any part of at least one primary cutter element on one cone cutter with the envelope defined by the extension of cutter elements on an adjacent cutter. Intermeshing is desired to reduce balling. As a row of cutting elements of one cone intermesh between the rows of cutting elements of another cone, it dislodges formation stuck between the rows of cutting elements on the adjacent cone. Moreover, having intermesh allows the diameter of the cones to be larger, providing for a larger bearing surface which results in a more durable cone. As shown in FIG. 2, grooves 49 allow bottomhole cutter elements 62 on adjacent cone cutters to intermesh farther between the cones 1-3. In some cases, selected cutting elements may be arranged to intermesh over 50% of their length, wherein an intermeshed cutting element of one cone is overlapped over 50% of its length by a cutting element from an adjacent cone.

In some drilling applications, such as the drilling of carbonates in the Middle East, the relatively close spacing of cutting elements 80, 81 on cones 1-3 causes rows 80*a*, 81*a* to experience "balling" or "balling-up" of cuttings between them. Balling also tends to occur on other places on cones 1-3, such as between inner rows 81*a*, 82*a*, 83*a*. When bit balling occurs, it impedes the progress and ROP of the bit by preventing the cutting elements from penetrating completely into the earth formation, thereby tending to reduce the rate of penetration.

To address bit balling in these and other applications, nozzles have been typically placed along the outer periphery of the bit between each pair of cones to clean cuttings from the cones and/or the borehole bottom. In some cases, an additional nozzle is also positioned at the center of the bit in the dome region to direct fluid flow on top of the cones near the center of the bit. While these configurations have led to reduced bit balling, bit balling still frequently occurs between the cutting elements of the inner rows due to insufficient cleaning along the inner rows. To further address bit balling, a new nozzle arrangement was proposed which replaced the conventional center jet in the dome region with three smaller nozzles which were closely spaced near the center of the dome, each nozzle positioned above a cone to direct a jet of fluid on top of inner rows of the cone. While this configuration has been shown to provide enhanced cleaning of the cones it has also resulted in severe erosion of cone shell surfaces and premature loss of cutting elements from the cones.

The location, spacing, and orientation of these additional nozzles in the dome region have traditionally been restricted because nozzle boreholes are conventionally drilled through the pin side of the bit (e.g., through passage 24 from pin end 14). In particular, due to limited access to the interior dome region of the bit once the bit is assembled, for bit designs comprising multiple rows of cutting elements intermeshing between the cones, the conventional approach has been to (a) drill the nozzle bores or receptacles in the interior the dome through the pin side of the bit and (b) install the nozzles from the pin side.

Figure 3:
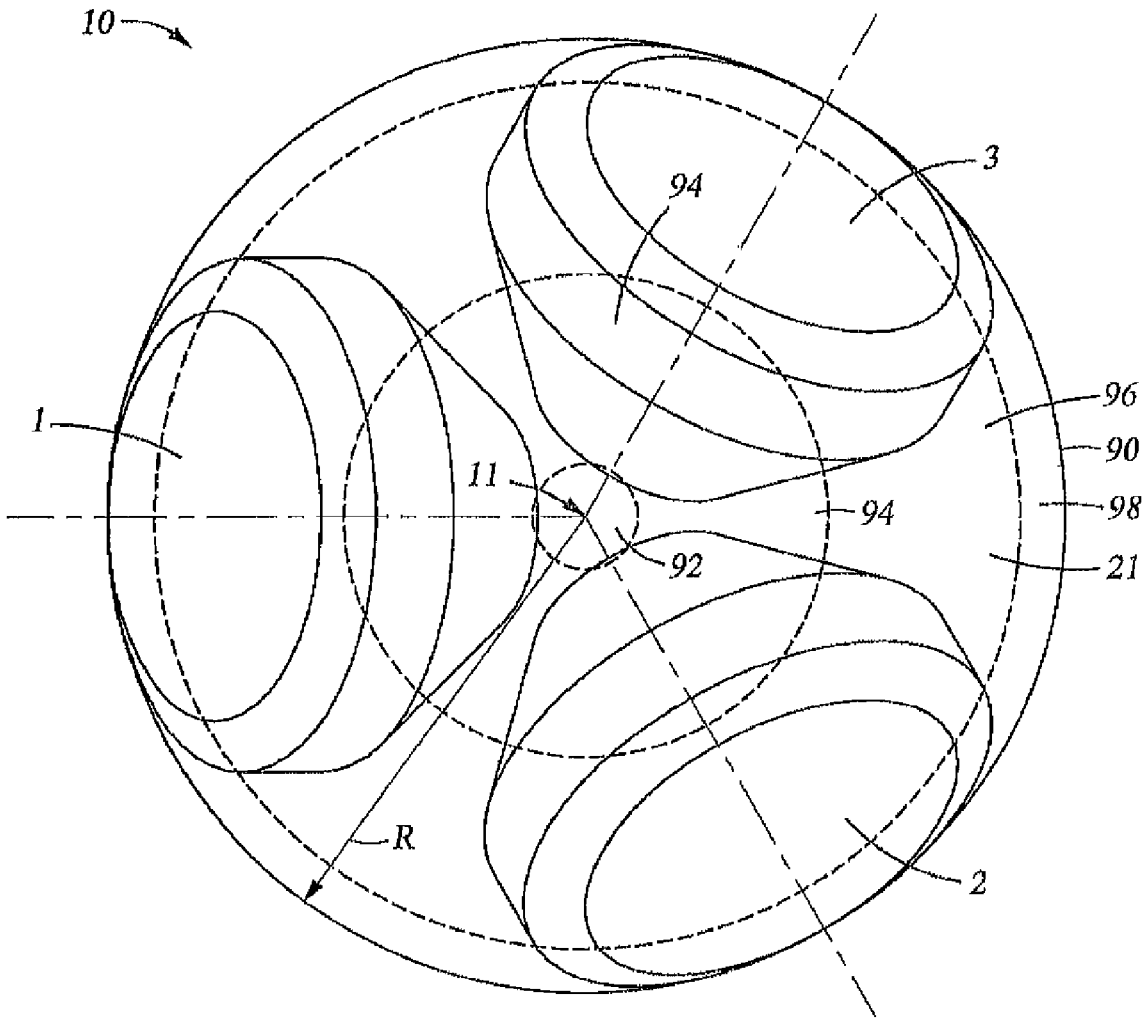
FIG. 3 is a schematic bottom end view of the rolling cone drill bit of FIG. 1 with rings superimposed on the rolling cone cutters to indicate the boundaries of the central, intermediate, outer, and gage regions of the bit.

Referring briefly to FIG. 3, a schematic bottom view of bit 10 and cones 1-3 is shown. The radially outermost reaches of cones 1-3 and cutter elements mounted therein (e.g., cutter elements 60, 70, 80, 81, 82, 83) define the full gage diameter of bit 10 represented by line 90. The full gage diameter 90 defines the bit radius R measured radially from bit axis 11. For purposes of the discussion below, the bottom of bit 10 and dome 21 may be divided into a plurality of annular regions between bit axis 11 and the full gage diameter 90. In particular, bit 10 may be described as having a first or central dome region 92 extending radially from bit axis 11 to about 10% of the bit radius R. Moving radially outward, bit 10 also includes a second or intermediate dome region 94 extending from central dome region 92 to about 50% of the bit radius R, a third or outer dome region 96 extending from intermediate dome region 94 to about 90% of the bit radius R, and a fourth or radially outermost gage dome region 98 extending from outer dome region 96 to full gage diameter 90 (i.e., extending to 100% the bit radius R).

Figure 4:
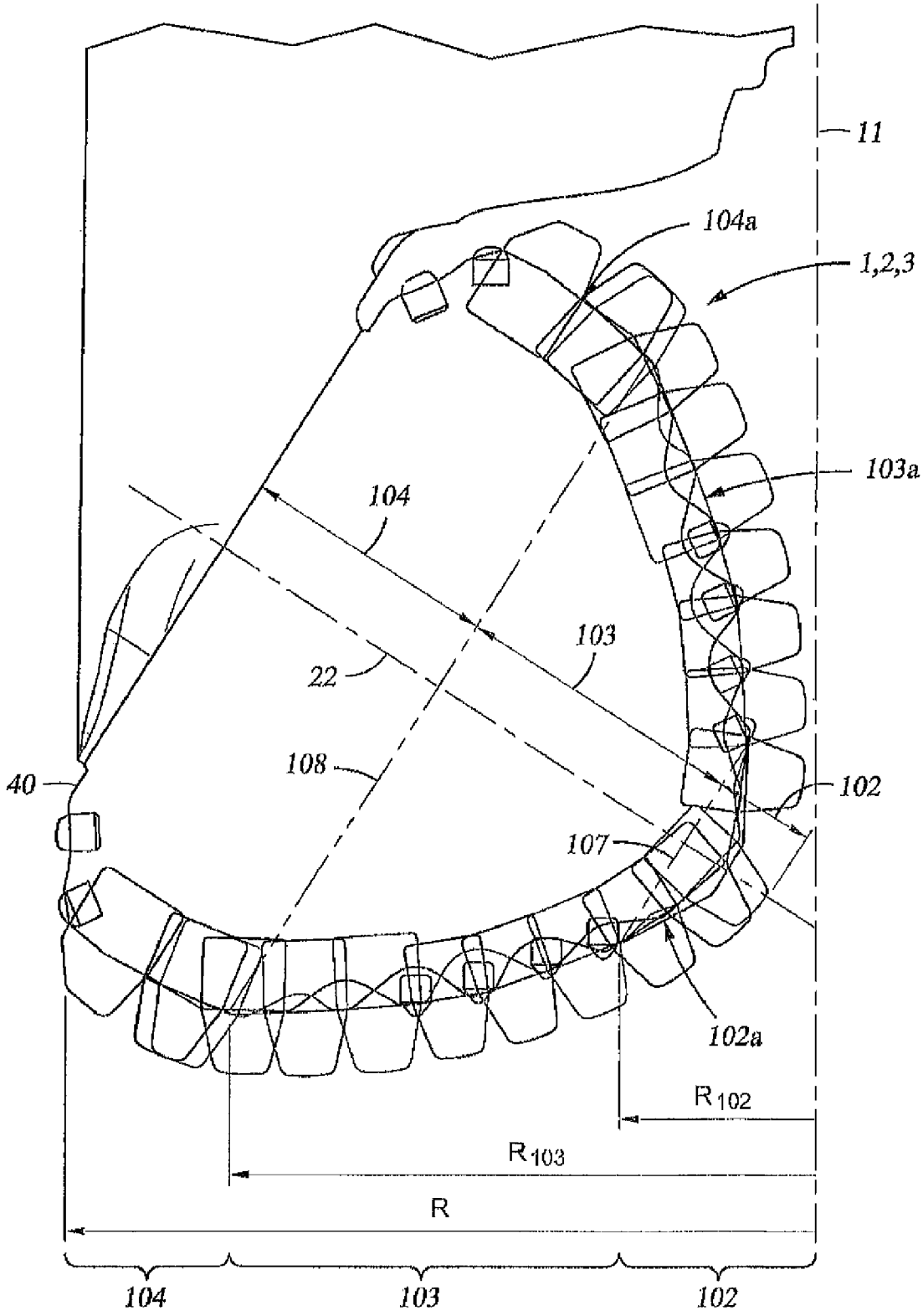
FIG. 4 is a partial view showing, schematically and in rotated profile, the cutting profiles of all of the cutting elements of the three cone cutters of the drill bit shown in FIG. 1.

Referring briefly to FIG. 4, the profiles of all three cones 1-3 and associated cutting elements are shown rotated into a single profile termed herein the "composite rotated profile view." In the composite rotated profile view, the overlap of the cutting profiles of cutting elements within each row is shown, as well as the overlap of different rows that are positioned on different cones. Consequently, the composite rotated profile view illustrated in FIG. 4 illustrates the bottomhole coverage of the entire bit 10.

Figure 5:
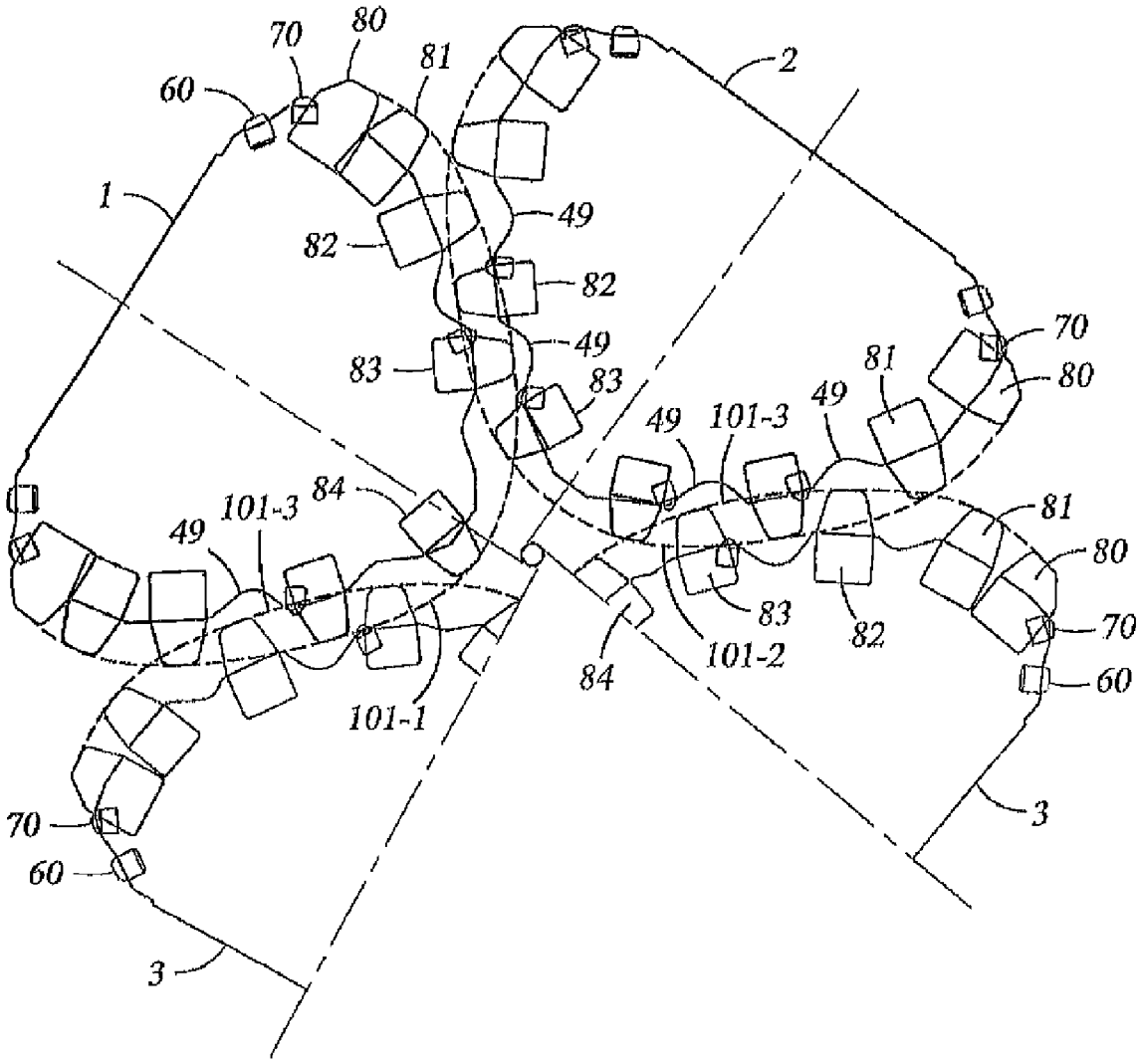
FIG. 5 is a schematic representation showing the intermesh of the three rolling cones of the bit shown in FIG. 1.

Referring now to FIG. 5, the intermeshed relationship between the cones 1-3 is shown. In this view, commonly termed a "cluster view," cone 3 is schematically represented in two halves so that the intermesh between cones 2 and 3 and between cones 1 and 3 may be simultaneously depicted. The term "intermesh" as used herein is defined to mean overlap of any part of at least one cutter element on one cone cutter with the envelope defined by the maximum extension of the cutter elements on an adjacent cutter. As shown in FIG. 5, each cone cutter 1, 2, 3 has an envelope 101-1, 101-2, 101-3, respectively, defined by the maximum extension height of the cutter elements on that particular cone. The cutter elements that "intersect" or "break" the envelope 101-1, 101-2, 101-3 of an adjacent cone "intermesh" with that adjacent cone. For example, cutting elements 82, 83 of cone 1 break envelope 101-2 of cone 2, and break envelope 101-3 of cone 3 and therefore intermeshes with both cone 2 and cone 3. However, cutting elements 60, 70, 80, 81 and 84 of cone 1 do not break envelope 101-2 or 101-3, and therefore, do not intermesh with either cone 2 or cone 3. Similarly, cutting elements 82, 83 of cone 3 break envelope 101-1 of cone 1, and break envelope 101-2 of cone 2 and therefore intermeshes with both cone 1 and cone 2, while cutting elements 60, 70, 80, 81, and 84 of cone 3 do not intermesh with either cone 1 or cone 2. Still further, cutting elements 81, 82, 83 of cone 2 break envelope 101-1 of cone 1, and break envelope 101-3 of cone 3 and therefore intermeshes with both cone land cone 3, while cutting elements 60, 70, 80 of cone 2 do not intermesh with either cone 1 or cone 3.

The intermeshing arrangement of cones 1-3 is also desirable to reduce balling. As a row of cutting elements of one cone intermesh between the rows of cutting elements of another cone, it dislodges balling between the rows of cutting elements on the adjacent cone. As shown in FIG. 4, grooves 49 allow the cutting surfaces of certain cutting elements of adjacent cone cutters 1-3 to pass between the cutting elements of adjacent cones 1-3 without contacting cone surface 46 of the adjacent cone cutter 1-3. In some cases, selected cutting elements may be arranged to intermesh over 50% of their length, wherein an intermeshed cutting element of one cone is overlapped over 50% of its length by a cutting element from an adjacent cone.

Moreover, having intermesh allows the diameter of the cones to be larger, providing for a larger bearing surface which results in a more durable cone. In general, performance expectations of rolling cone bits typically require that the cone cutters be as large as possible within the borehole diameter so as to allow use of the maximum possible bearing size and to provide a retention depth adequate to secure the cutter element base within the cone steel. Intermeshing cutting elements of adjacent cones offers the potential to achieve maximum cone cutter diameter and still have acceptable insert retention and protrusion.

As best shown in FIG. 4, moving axially relative to cone axis 22 from proximal bit axis 11 toward backface 40, each cone 1-3 may be divided into three bands or regions—an inner cone region 102, an intermediate cone region 103, and an outer cone region 104. Inner cone region 102 is disposed 360° about cone axis 22 and extends axially (relative to cone axis 22) from proximal bit axis 11 to intermediate cone region 103. The intersection of inner cone region 102 and intermediate cone region 103 is denoted by a first boundary line 107 generally perpendicular to cone axis 22. Intermediate cone region 103 is disposed 360° about cone axis 22 and extends axially (relative to cone axis 22) from inner cone region 102 to outer cone region 104. The intersection of intermediate cone region 103 and outer cone region 104 is denoted by a second boundary line 108 generally perpendicular to cone axis 22. Outer cone region 104 is disposed 360° about cone axis 22 and extends from intermediate cone region 103 to cone backface 40.

Intermediate cone region 103 has an associated cone shell surface 103*a*, and in this embodiment, generally includes all of the intermeshing cutting elements (e.g., cutting elements 82, 83). Inner cone region 102 has an associated cone shell surface 102*a* including nose 42, and in this embodiment, generally includes the radially inner (relative to bit axis 11) non-intermeshing cutting elements (e.g., cutting elements 84). Outer cone region 104 has an associated cone shell surface 104*a*, and in this embodiment, generally includes the radially outer (relative to bit axis 11) non-intermeshing cutting elements (e.g., gage cutting elements 80 and first inner row cutting elements 81).

Referring still to FIG. 4, relative to the borehole bottom and the position of the cutting elements at their lowermost position (i.e., at bottom dead center), inner cone region 102 extends radially (relative to bit axis 11) from proximal bit axis 11 to an first radius $R_{102}$, intermediate cone region 103 extends radially (relative to bit axis 11) from inner cone region 102 to a second radius $R_{103}$, and outer cone region 104 extends radially (relative to bit axis 11) from intermediate region 103 to bit radius R previously described with reference to FIG. 3. In this embodiment, first radius $R_{102}$ is about 25% of bit radius R, and second radius $R_{103}$ is about 75% of bit radius R.

FIGS. 6-9 illustrate the structural design and layout of the hydraulics of bit 10. For purposes of clarity, cones 1-3 and the cutting elements mounted thereon are omitted from FIG. 6. The resulting drilling fluid flow trajectories, cutting structure cleaning, and bottomhole cleaning of bit 10 will be described in more detail below in conjunction with FIGS. 10-13.

Referring now to FIGS. 6-9, bit 10 includes a central sleeve receptacle 15, a plurality of intermediate sleeve receptacles 25, and a plurality of outer sleeve receptacles 35. As used herein, the phrase "sleeve receptacle" may be used to refer to a receptacle or bore in the bit body that receives a sleeve. As will be explained in more detail below, each sleeve is adapted to receive a jet or nozzle in its downstream end. In other words, a sleeve is employed to couple a jet or nozzle to a sleeve receptacle. Although receptacles 15, 25, 35 have each been described as a "sleeve receptacle," in other embodiments, one or more of the receptacles (e.g., receptacles 15, 25, 35) may be tapped to directly receive a nozzle without the use of a sleeve.

Figure 6:
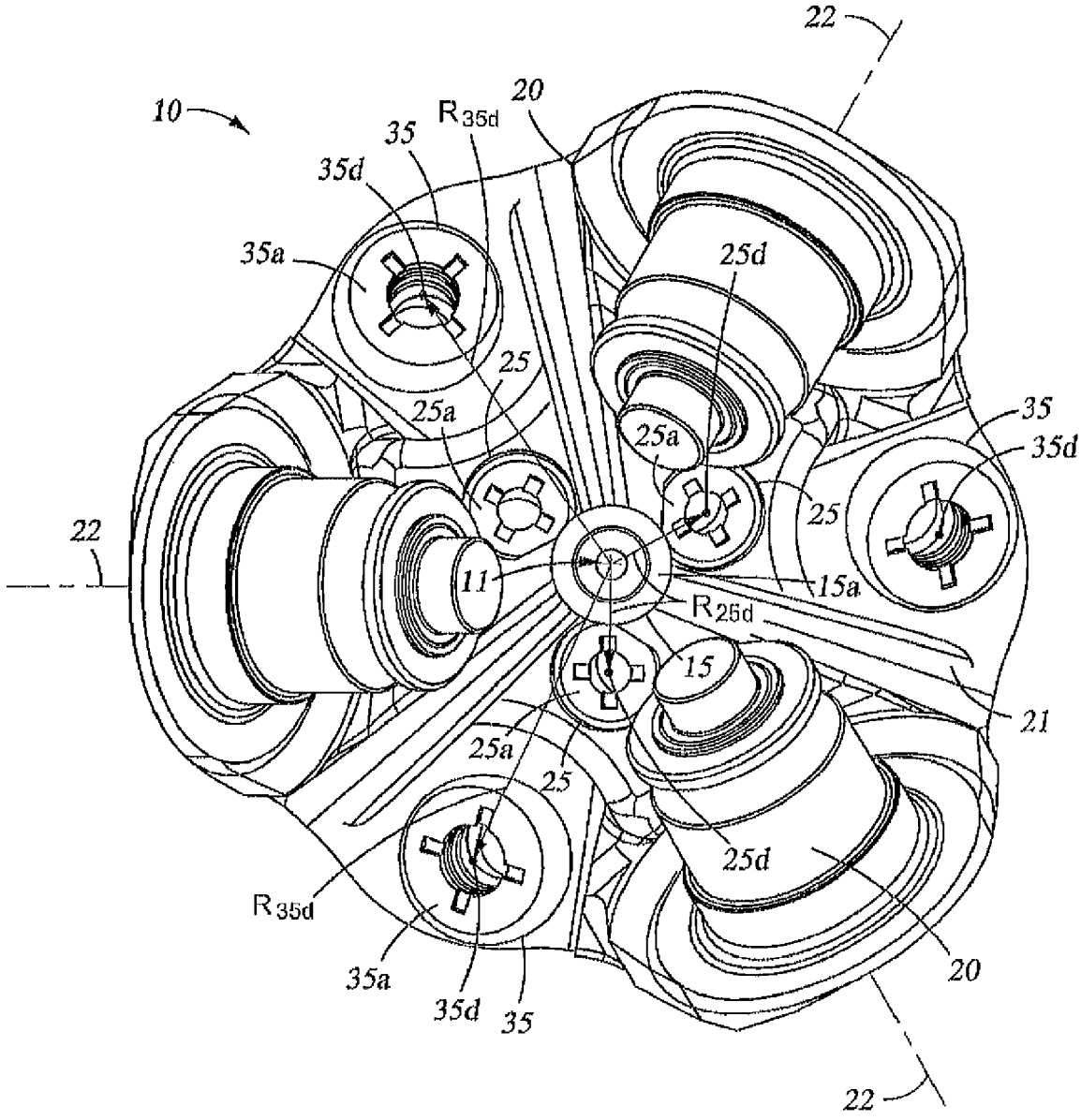
FIG. 6 is a bottom end view of the bit of FIG. 1 with the cones and cutting structure omitted for clarity purposes.

As best shown in FIG. 6, central sleeve receptacle 15 is positioned proximal the center of dome 21 within central dome region 92 previously described. Outer sleeve receptacles 35 are radially positioned at the outer periphery of dome 21 within outer dome region 96 previously described. Intermediate sleeve receptacles 25 are radially positioned radially between central sleeve receptacle 15 and outer sleeve receptacles 35 within intermediate dome region 94 previously described. More specifically, referring briefly to FIG. 7, each outer sleeve receptacles 35 is positioned such that the center of its downstream end at dome side 21 is located at a radius $R_o$, measured perpendicularly from bit axis 11, preferably between 60% and 90% of the bit radius R, more preferably between 60% and 80% of the bit radius R. Further, each intermediate receptacle is positioned such that the center of its downstream end at dome side 21 is positioned at a radius $R_i$, measured perpendicularly from bit axis 11, preferably between 15% and 45% of the bit radius R, more preferably between 25% and 35% of the bit radius R, and even more preferably between 25% and 30% of the bit radius R.

Referring again to FIGS. 6-9, in this embodiment, intermediate sleeve receptacles 25 are uniformly spaced about 120° apart about bit axis 11, and outer sleeve receptacles 35 are uniformly spaced about 120° apart about bit axis 11. However, in other embodiments, one or more of the intermediate nozzle receptacles, the outer sleeve receptacles, or combinations thereof may be spaced differently.

In general, each leg 19 may be formed by conventional manufacturing techniques. Once leg 19 is formed, sleeve receptacles 25, 35 may be drilled or bored into leg 19. It should be appreciated that intermediate sleeve receptacles 25 are in close proximity to finished journal pin 20. Consequently, the drilling or boring operation to form receptacles 25 is preferably performed with great care and attention to avoid damaging the journal surface.

In this embodiment, each receptacle 15, 25, 35 is a substantially straight, cylindrical bore having a single central axis 15', 25', 35', respectively. However, in other embodiments, one or more receptacles (e.g., receptacles 15, 25, 35) may include a turn or bend. In other words, in other embodiments, one or more receptacles may have a first or upstream section extending along a first central axis and a second or downstream section extending along a second central axis that is skewed relative to the first central axis as described in U.S. patent application Ser. No. 12/104,856 filed Apr. 17, 2008, and entitled "Rock Bit with Vectored Hydraulic Nozzle Sleeves", which is hereby incorporated herein by reference in its entirety.

Although a central sleeve receptacle (e.g., central sleeve receptacle 15) is included in this embodiment, in other embodiments, the central sleeve receptacle may be omitted. Inclusion of a central sleeve receptacle may be dictated by a variety of factors including, without limitation, the size of the bit. For example, in relatively larger bits (e.g., bits a diameter greater than about 20.00 inches), there may be sufficient space on the underside (e.g., dome 21) for a central sleeve receptacle, intermediate sleeve receptacles (e.g., intermediate sleeve receptacles 25), and outer sleeve receptacles (e.g., outer sleeve receptacles 35). However, as the bit diameter decreases (e.g., bits having a diameter less than 20.00 inches), the intermediate sleeve receptacles are often moved radially inward toward the bit axis. If the intermediate sleeve receptacles are moved sufficiently inward, there may not be adequate space to include a central sleeve receptacle.

Figure 7:
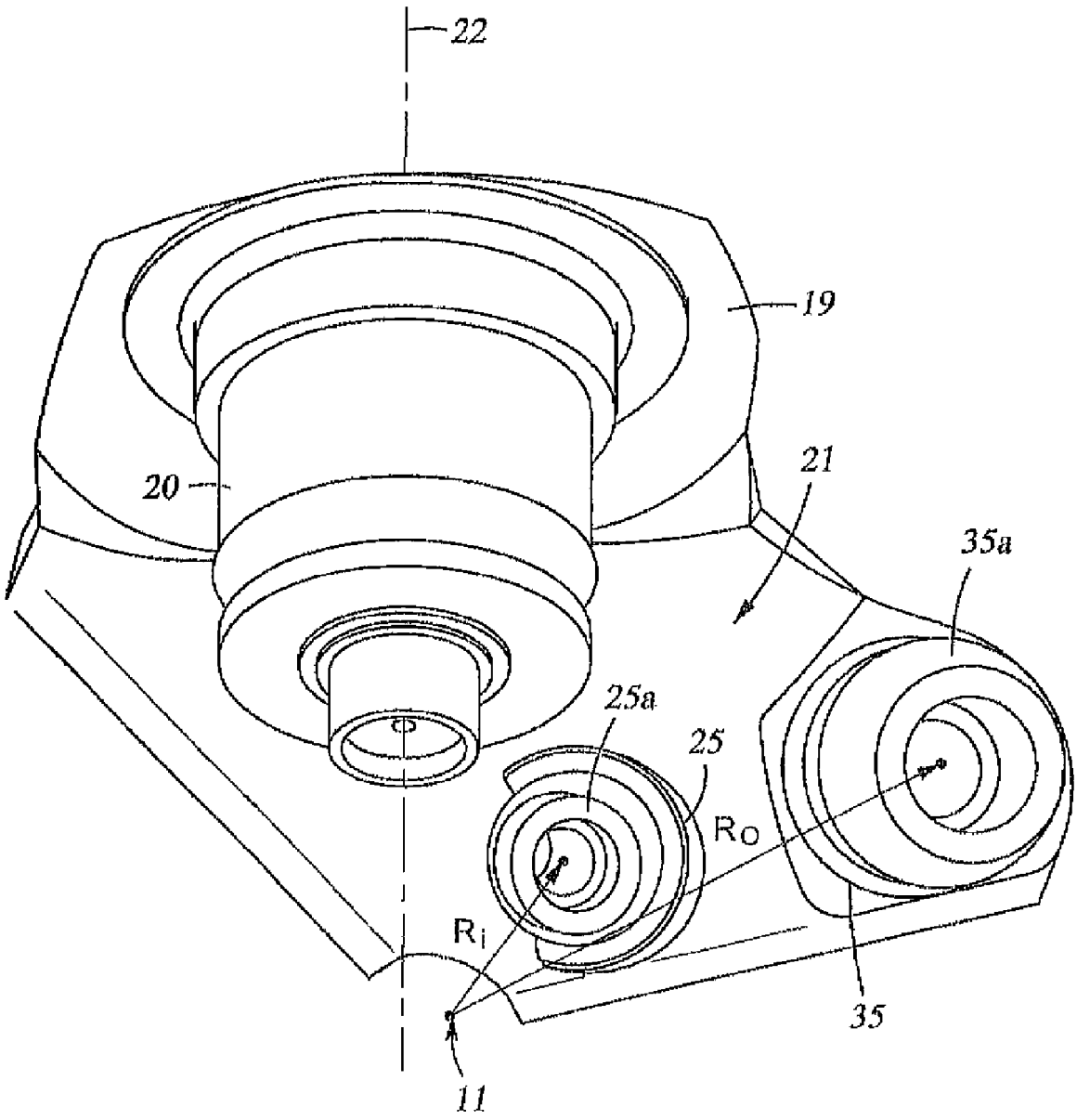
FIG. 7 is a bottom end view of one of the legs of the bit of FIG. 1 prior to the assembly of the bit.

As best shown in FIG. 7, each bit leg 19 includes one intermediate sleeve receptacle 25 and one outer sleeve receptacle 35. On a given leg 19, sleeve receptacles 25, 35 are laterally offset and angularly spaced from the cone or journal axis 22 relative to the bit axis 11. The radially innermost portion of each leg 19 defines a portion of central sleeve receptacle 15. Upon assembly of legs 19 to form bit body 12, one intermediate sleeve receptacle 25 and one outer sleeve receptacle 35 is circumferentially positioned between cone or journal axes 22 of adjacent cones 1-3, and circumferentially positioned between each pair of adjacent legs 19. Further, upon assembly of legs 19 to form bit body 12, central sleeve receptacle 15 is formed by the radially innermost portions of legs 19.

Figure 9:
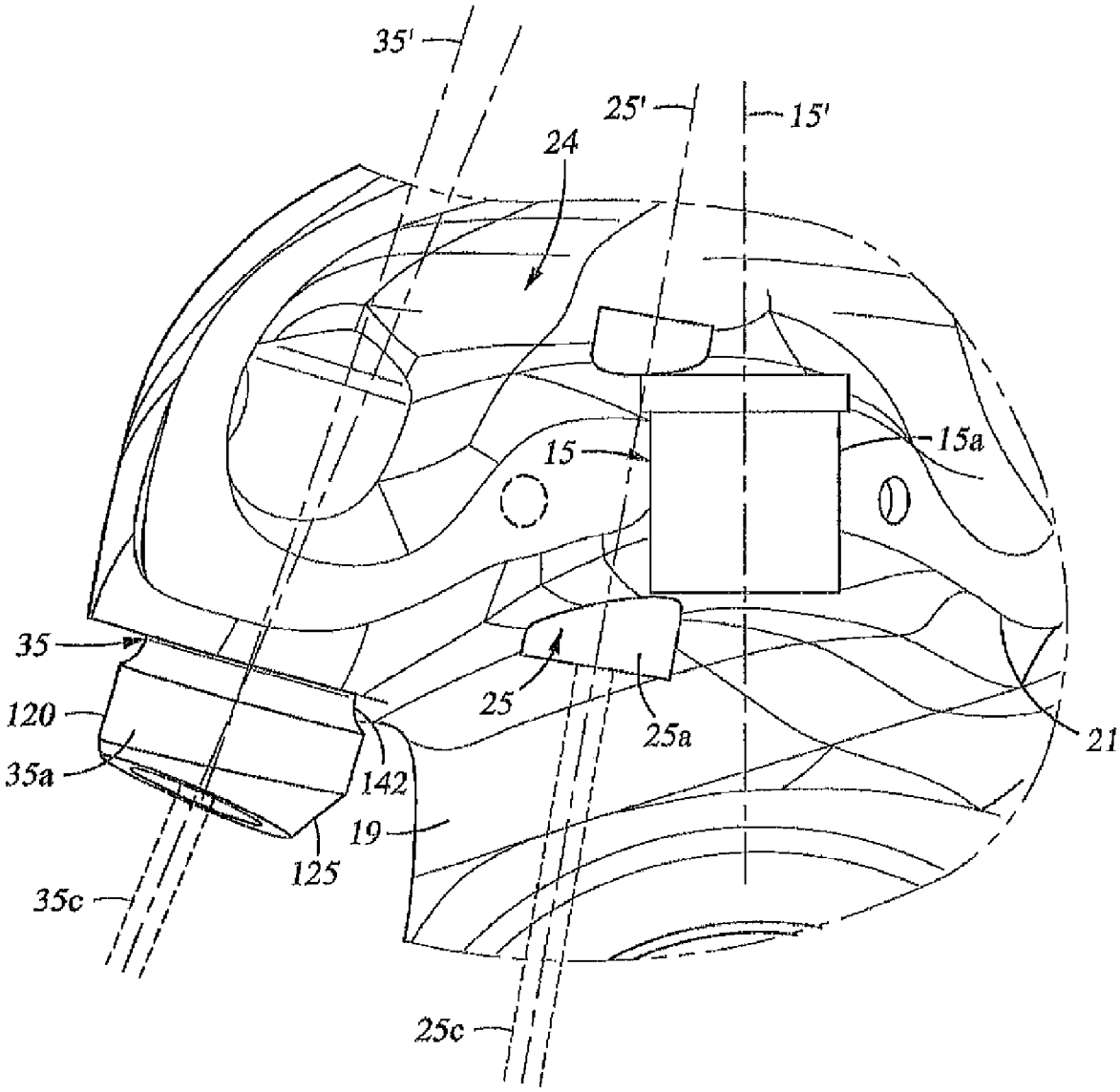
FIG. 9 is a side view of one of the legs of the bit of FIG. 1 illustrating the centerlines of the center, intermediate, and outer bores.

Referring now to FIGS. 6, 7, and 9, a central sleeve **15*a* is at least partially disposed in central sleeve receptacle 15, an intermediate sleeve 25*a* is at least partially disposed in each intermediate sleeve receptacle 25, and an outer sleeve 35*a* is at least partially disposed in each outer sleeve receptacle 35. In this embodiment, the geometry of the inserted portion of each sleeve 15*a*, 25*a*, 35*a* is adapted to mate with the geometry of its respective receptacle 15, 25, 35. In this particular embodiment, receptacles 15, 25, 35 are cylindrical, and thus, the inserted portions of sleeves 15*a*, 25*a*, 35*a*, respectively, are also cylindrical. However, other suitable geometries and shapes may be employed for the sleeves and receptacles. In general, each sleeve 15*a*, 25*a*, 35*a* may be secured in mating sleeve receptacle 15, 25, 35, respectively, by any suitable means including, without limitation, threading, press-fitting, welding, and retention by snap rings. However, to form a rigid connection capable of withstanding extreme downhole drilling conditions, sleeves 15*a*, 25*a*, 35*a* are preferably positioned in mating receptacles 15, 25, 35, respectively, and then welded to bit body 12 from dome side 21**.

As best shown in FIG. 9, once positioned in receptacles 15, 25, 35, each sleeve **15*a*, 25*a*, 35*a* has an upstream end in fluid communication with plenum 24 and a downstream end proximal or extending from dome 21. In this embodiment, central sleeve 15*a* and intermediate sleeves 25*a* are generally flush with bit body 12, however, outer sleeves 35*a* extend from bit body 12**.

As previously described, central sleeve receptacle 15 is radially positioned within central dome region 92, outer sleeve receptacles 35 are each radially positioned within outer dome region 96, and intermediate sleeve receptacles 25 are each radially positioned within intermediate dome region 94. More specifically, as best shown in FIG. 6, the downstream end of each sleeve 25*a*, 35*a* has a center 25*d*, 35*d*, respectively, disposed at a radius $R_{25d}$, $R_{35d}$, respectively, measured perpendicularly from bit axis 11. Each intermediate receptacle 25 and associated intermediate sleeve 25*a* is positioned such that each radius $R_{25d}$ is preferably between 15% and 45% of the bit radius R, more preferably between 25% and 35% of the bit radius R, and even more preferably between 25% and 30% of the bit radius R. Further, ach outer receptacle 35 and associated outer sleeve 35*a* is positioned such that each radius $R_{35d}$ is preferably between 60% and 90% of the bit radius R, more preferably between 60% and 80% of the bit radius R. An exemplary bit designed in accordance with this aspect and having a diameter of 17.5 inches includes thee outer sleeve receptacles (e.g., outer sleeve receptacles 35), each having a downstream exiting center (e.g., center 35*d*) radially positioned at about 70% of the bit radius (e.g., $R_{35d}$ is about 70% of radius R), and three intermediate nozzle receptacles (e.g., intermediate sleeve receptacles 25), each having a downstream exiting center (e.g., center 25*d*) radially positioned at about 26% of the bit radius (e.g., $R_{25d}$ is about 26% of radius R). In this embodiment, each intermediate sleeve 25*d* is disposed at substantially the same radius $R_{25d}$, and each outer sleeve 35*d* is disposed at substantially the same radius $R_{35d}$, however, in other embodiments, one or more intermediate sleeve and/or outer sleeve may be disposed at a different or unique radial position.

Prior to drilling, a jet or nozzle (not shown) is disposed in the downstream end of each sleeve 15*a*, 25*a*, 35*a*. Consequently, each sleeve 15*a*, 25*a*, 35*a* may also be referred to as "nozzle retention sleeve." In general, each nozzle may be secured within the downstream end of its mating nozzle retention sleeve (e.g., sleeve 15*a*, 25*a*, 35*a*) by any suitable means including, without limitation, mating threads, press-fitting, welding, snap rings, or combinations thereof. Each nozzle is preferably releasably received by its mating nozzle retention sleeve such that the nozzles may be replaced or changed in the field depending on the desired flow rate through each nozzle and desired flow pattern. In some embodiments, one or more of the sleeves (e.g., central sleeve 15*a*) may be "blanked," such that the downstream end of the sleeve is completely closed off, thereby preventing the flow of drilling fluid through the sleeve.

For purposes of the following explanation, the nozzles secured within outer sleeves 35*a* will be referred to as "outer nozzles," the nozzles secured within intermediate sleeves 25*a* will be referred to as "intermediate nozzles," and the nozzle secured within central sleeve 15*a* will be referred to as the "central nozzle." In general, the outer nozzles, the intermediate nozzles, and the central nozzle may be any suitable type of nozzle including, without limitation, straight bore nozzles, multistage nozzles, diffusing nozzles, etc. In a straight bore nozzle, the area of the nozzle throat is generally the same size as the nozzle outlet. In a multistage nozzle, the upstream portion of the nozzle has a converging section and the downstream end includes a distributor having a plurality of exit holes, usually three exit holes. Drilling fluid flowing through a multistage nozzle is accelerated towards the distributor, where the fluid flow is divided into multiple streams by the distributor, which may target different areas of the bit and/or borehole. Due to impingement with the distributor, streams of drilling fluid exiting a multistage nozzle tend to have lower velocities and energy, and thus, generally present a reduced likelihood of causing cone erosion. A variety of multistage nozzles are described in U.S. Pat. Nos. 6,585,063 and 7,188,682, each of which is incorporated herein by reference in its entirety. In a diffusing nozzle, the outlet portion diverges from a smaller diameter portion within the orifice. Consequently, drilling fluid exiting a diffuser nozzles diffuses and diverges so as to potentially cover an increased target cleaning area. A variety of diffusion nozzles are described in U.S. Pat. No. 5,601,153, which is hereby incorporated herein by reference in its entirety. Since cone shell erosion and associated premature loss of cutting elements is more likely with streamlined or culminated flow, the outer nozzles and intermediate nozzles are preferably diffuser nozzles, and the central nozzle is preferably a diffuser nozzle or multistage nozzle. Each nozzle is preferably formed of a wear resistant material such as cemented tungsten carbide.

Without being limited by this or any particular theory, the greater the nozzle orifice diameter (or the sum of the orifice diameters in a multistage nozzle), the greater the total drilling fluid volumetric flow through the nozzle. Thus, the orifice diameters of the nozzles may be sized or selected to provide the desired drilling fluid flow allocation through the plurality of nozzles. In this embodiment, each outer nozzle has an orifice of a selected minimum diameter D, and each intermediate nozzle has an orifice of a selected minimum diameter d that is less than diameter D. Consequently, a drilling fluid volumetric flow through the outer nozzles is greater than the drilling fluid volumetric flow through the intermediate nozzles. In one embodiment, the nozzle orifice diameters D, d are preferably selected to provide a drilling fluid volumetric flow allocation ranging from 45% to 80% through the outer nozzles and from 20% to 55% through the intermediate nozzles, and more preferably a drilling fluid volumetric flow of 55% to 70% through the outer nozzles and 30 to 45% through the intermediate nozzles. In embodiments including a center nozzle, preferably at least 10% of the drilling fluid volumetric flow rate is directed through the center nozzle to alleviate bit balling near the center of the cones and/or to ensure that the fluid or mud flow carrying cuttings will flow radially outward from the center of the borehole and up the annulus formed between the bit and the borehole.

FIGS. 10-13 illustrate the stream or trajectory of drilling fluid exiting each sleeve 25*a*, 35*a* and associated nozzle (not shown). For purposes of clarity, the stream or trajectory of drilling fluid exiting center sleeve 15*a* and associated center nozzle are not shown. Although the jet or stream of drilling fluid exiting each sleeve (e.g., sleeve 25*a*, 35*a*) and each nozzle (e.g., intermediate nozzle, outer nozzle, etc.) behaves in a complex manner, the general direction and orientation of discharged drilling fluid is generally represented by a projected centerline from the sleeve and nozzle outlets to simplify the discussion and to emphasize the general direction of drilling fluid flow. In particular, centerlines 25*c*, 35*c* generally indicate the stream or trajectory of drilling fluid exiting sleeves 25*a*, 35*a*, respectively, and the intermediate and outer nozzles, respectively, disposed therein. Centerlines 25*c*, 35*c* are generally coincident with the projection of the central axis of receptacles 25, 35, respectively, at its respective downstream end. Further, contact points 25*c*', 35*c*' generally indicate the intersection of centerlines 25*c*, 35*c*, respectively, with borehole bottom 7. Although intermediate sleeve receptacles 25 and intermediate sleeves 25*a* are disposed beneath cones 1-3 in FIG. 11, and thus, are not visible in FIG. 11 their general location has been labeled so that the exiting point of each centerline 25*c* from its respective sleeve 25*a* and associated nozzle is clear.

Figure 10:
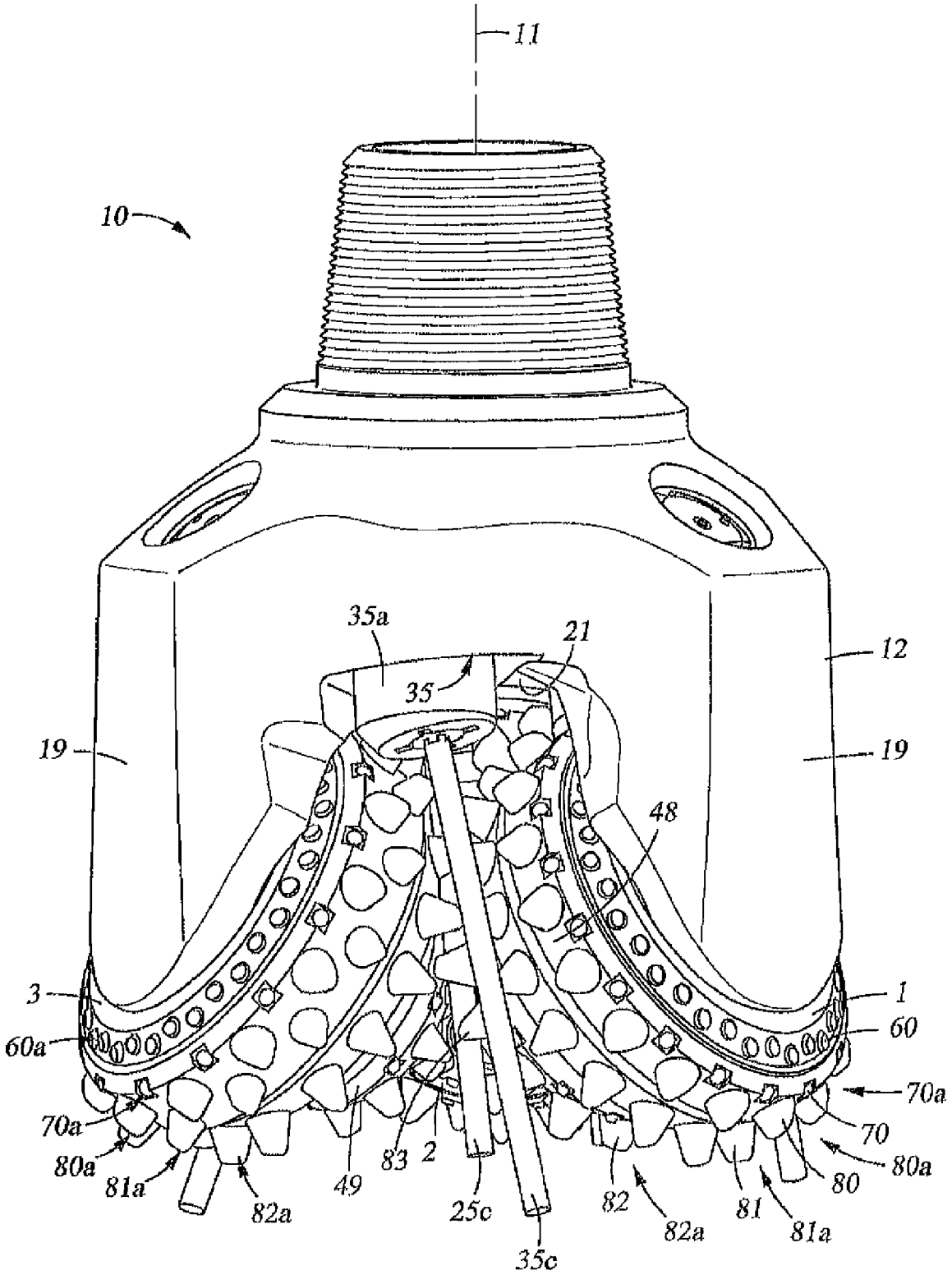
FIG. 10 is an enlarged side view of the bit of FIG. 1 illustrating the exiting centerlines of the intermediate and outer bores.
Figure 11:
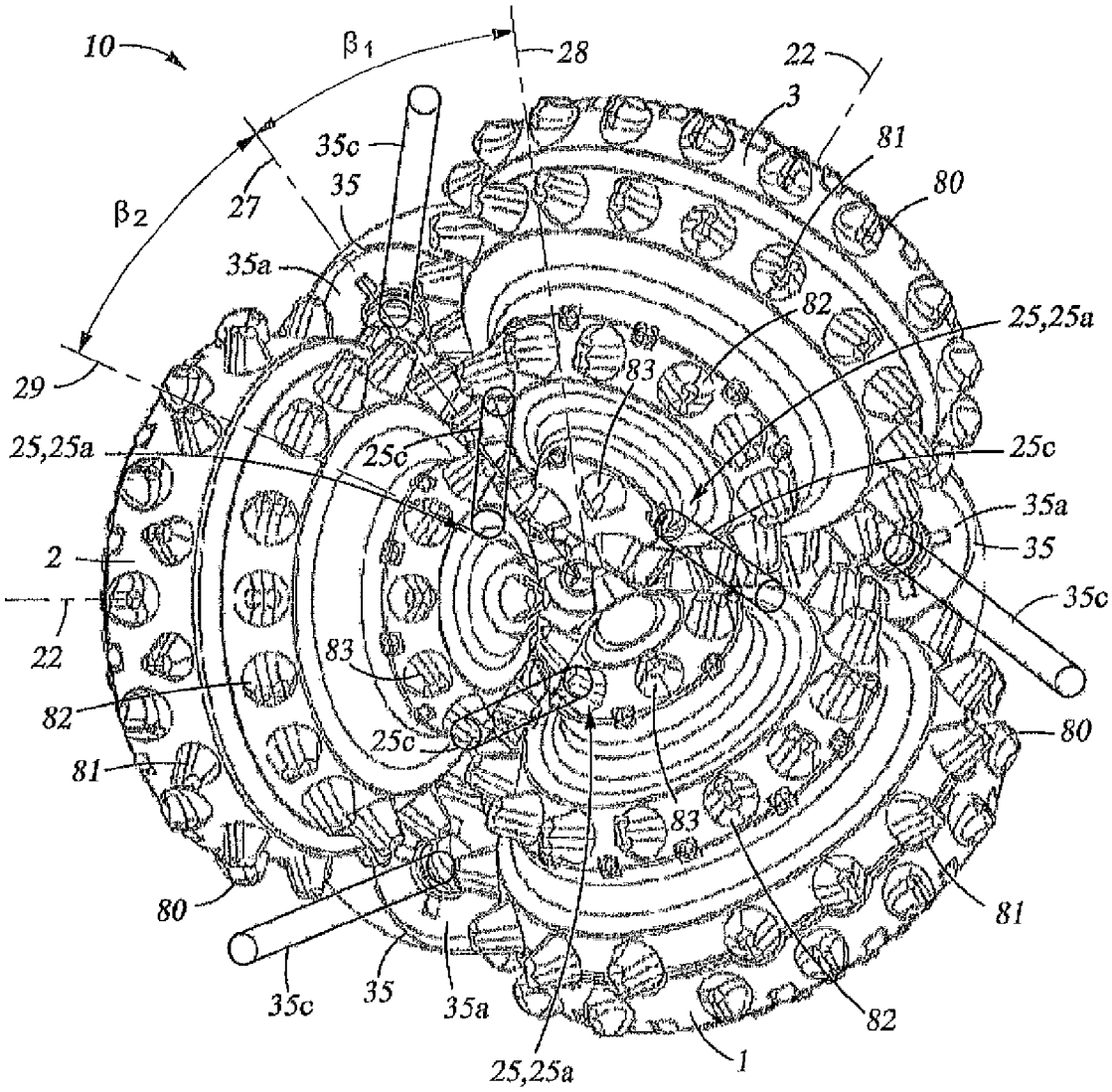
FIG. 11 is a bottom end view of the bit of FIG. 1 illustrating the exiting centerlines of the sleeves.
Figure 12:
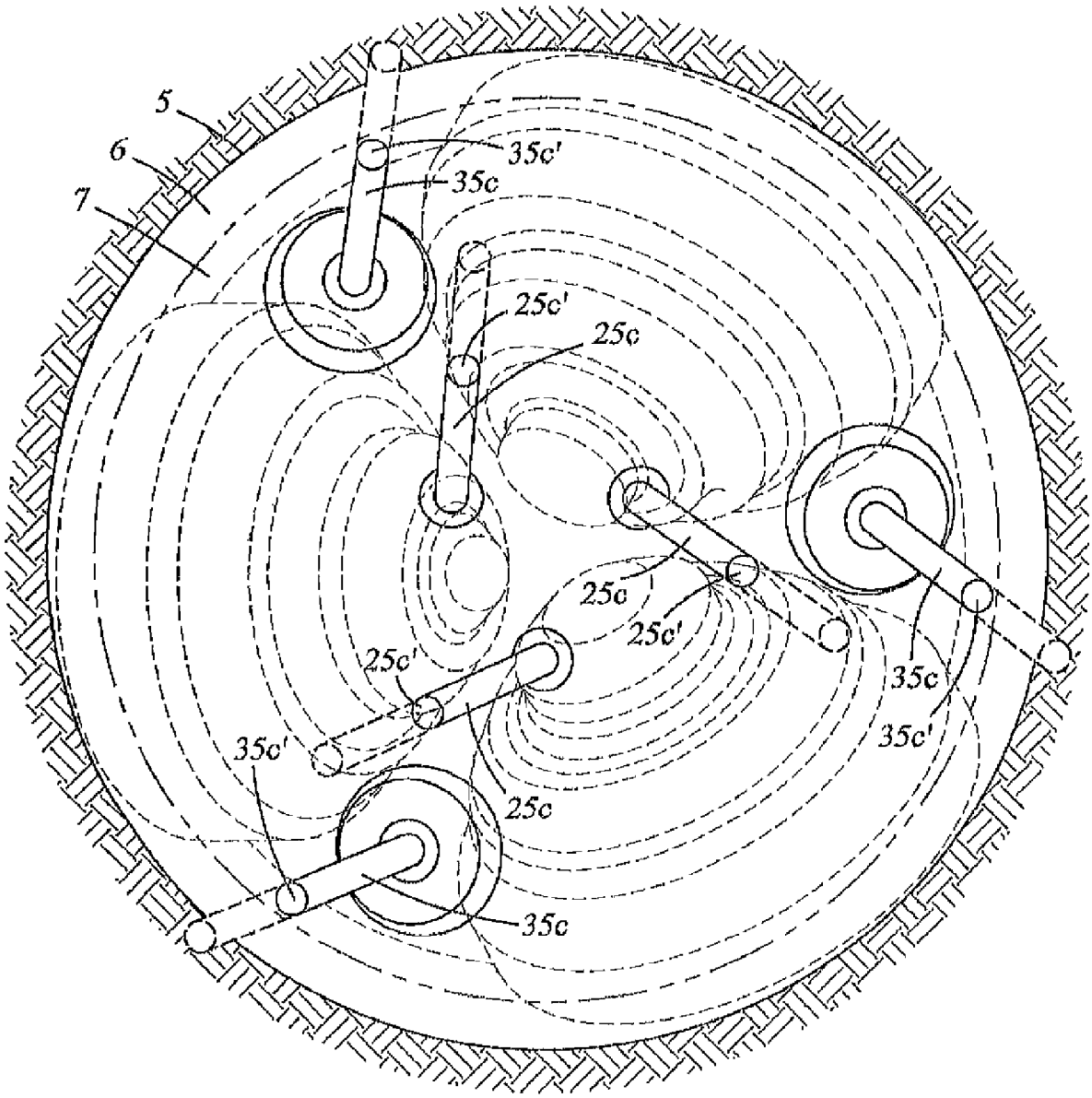
FIG. 12 is a bottom end view of the bit of FIG. 1 with the borehole bottom shown in phantom to illustrate locations where drilling fluid trajectories impact with the borehole bottom.
Figure 13:
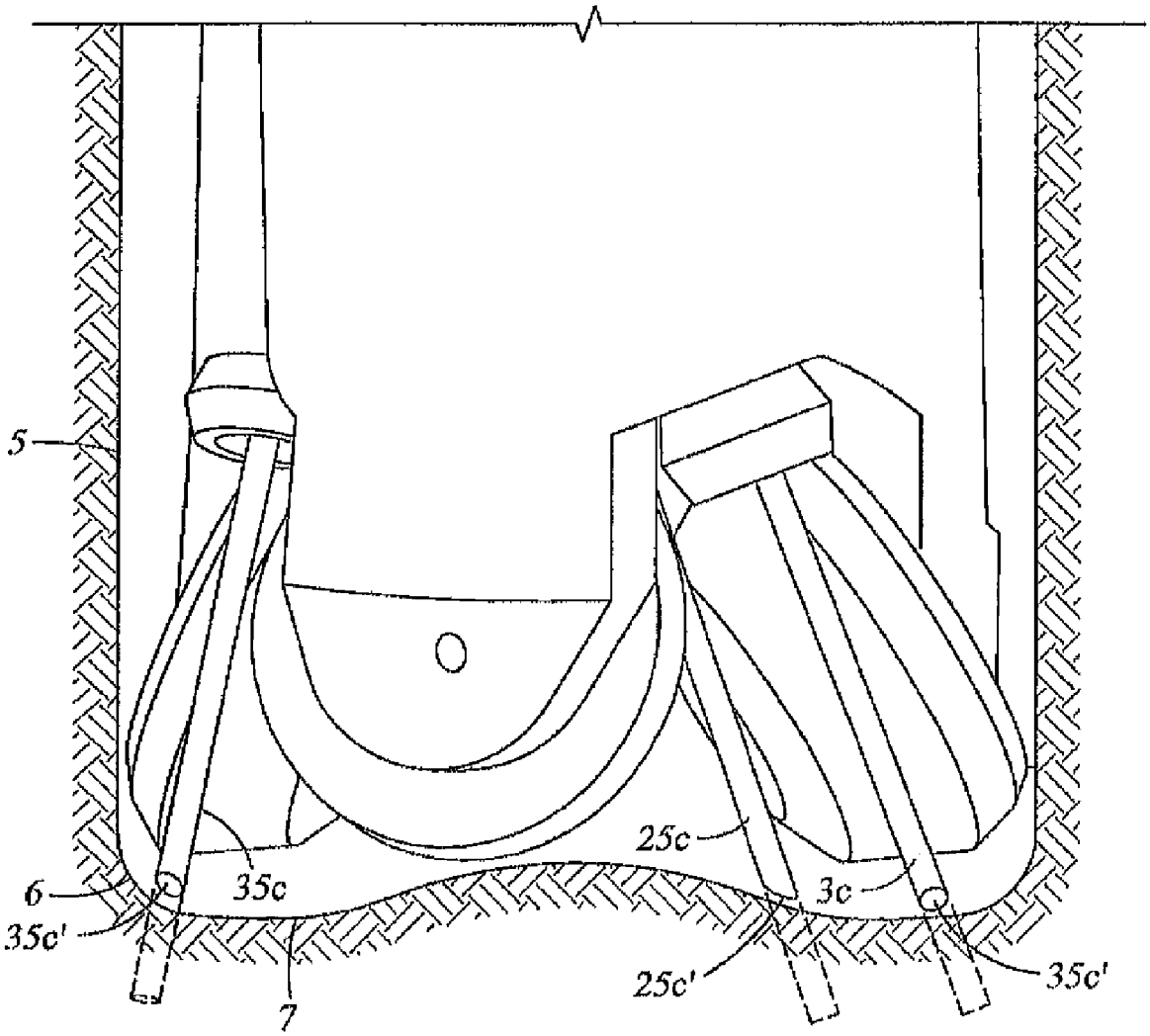
FIG. 13 is a side view of the bit of FIG. 1 with the borehole bottom and sidewall shown in phantom to illustrate locations where drilling fluid trajectories impact with the borehole.

As indicated by each centerline 35*c*, outer sleeves 35*a* and associated outer nozzles are generally positioned and oriented to direct drilling fluid generally downward toward the cutting elements between outer regions 104 of each pair of adjacent cones 1-3. More specifically, the stream of drilling fluid represented by centerline 35*c* first strikes the tips of gage cutting elements 80 and inner row cutter elements 81 in outer regions 104 as they rotate between cones 1-3 to wash cuttings from therefrom (FIGS. 10 and 11). The stream of drilling fluid represented by centerline 35*c* continues along its generally downward trajectory until it impinges borehole bottom 7 at contact points 35*c*' to flush cuttings from the portion of borehole bottom 7 extending along outer regions 104 (FIGS. 12 and 13).

As indicated by centerlines 25*c*, intermediate sleeves 25*a* and associated intermediate nozzles are generally positioned and oriented to direct drilling fluid generally downward toward the cutting elements between intermediate regions 103 of each pair of adjacent cones 1-3. More specifically, the stream of drilling fluid represented by centerline 25*c* first strikes cutting elements 82, 83 in inner rows 82*a*, 83*a* in intermediate regions 103 as they rotate between cones 1-3 to wash cuttings therefrom (FIGS. 10 and 11). The stream of drilling fluid represented by centerline 25*c* continues along its generally downward trajectory until it impinges borehole bottom 7 at contact points 25*c*' to flush cuttings from the portion of borehole bottom 7 extending along intermediate regions 103 (FIGS. 12 and 13).

Figure 8:
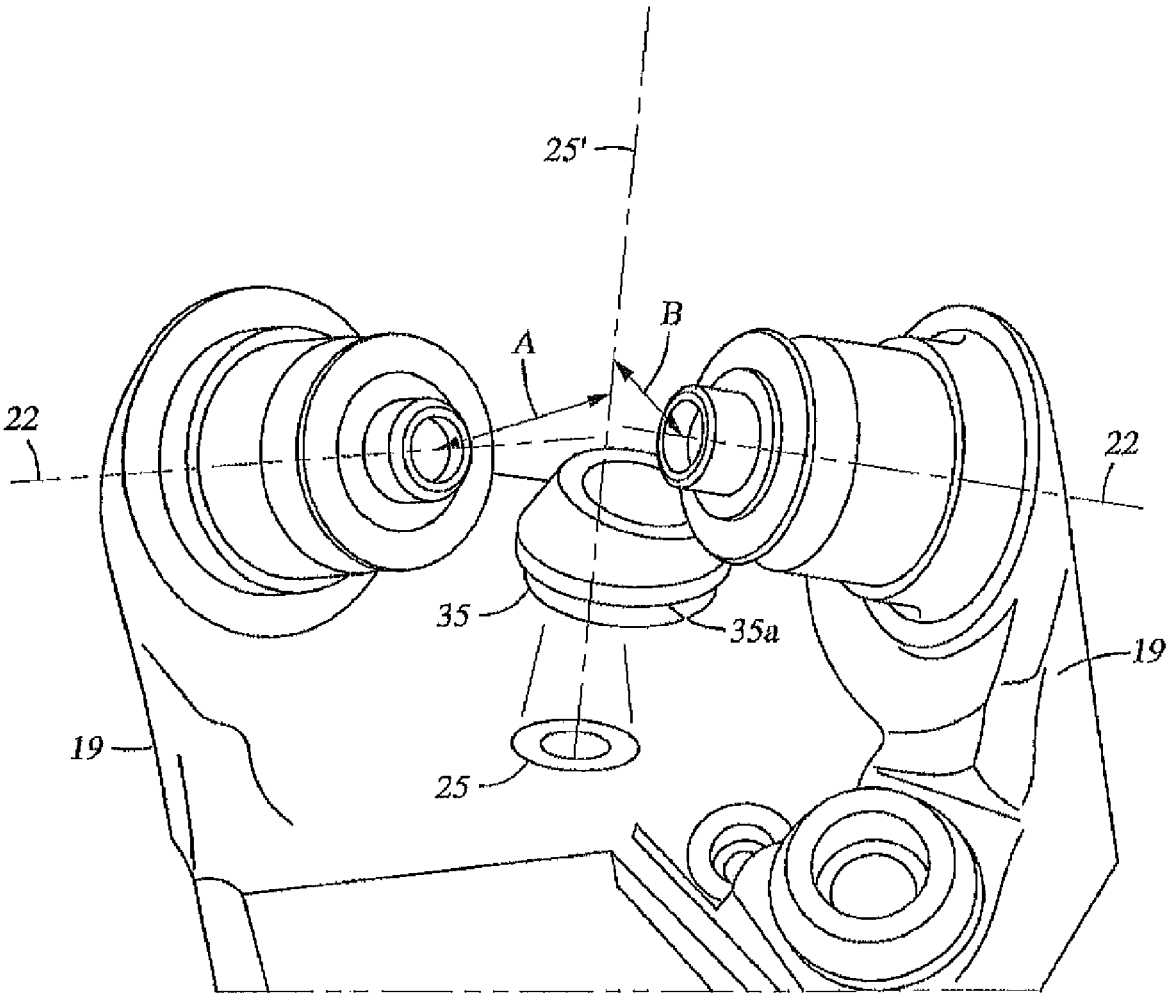
FIG. 8 is a perspective view of two of the legs of the bit of FIG. 1 joined together and illustrating the position of an intermediate bore with respect to journal axes of adjacent rolling cone cutters.

As best shown in FIG. 8, the orientation of each centerline 25*c*, and hence the trajectory of the drilling fluid exiting each intermediate sleeve 25*a* and associated nozzle, may also be defined in terms of a ratio of two distances measured between centerline 25*c* and each adjacent journal axis 22. In particular, a first distance A is the shortest distance measured between centerline 25*c* and a first of the adjacent journal axes 22 (left journal axis in FIG. 8), and a second distance B is the shortest distance measured between centerline 25*c* and a second of the adjacent journal axes 22 (right journal axis in FIG. 8). The ratio of distance A to distance B is preferably between 0.5 and 2.0. In such case, this range would also be the same for a ratio of distance B to distance A. For most applications, such a preferred ratio of distance A to distance B will result in a drilling fluid trajectory centerline 25*a* that at least partially directed toward the cutting elements between intermediate regions 103 of each pair of adjacent cones 1-3.

As best shown in FIG. 11, each intermediate sleeve receptacle 25, intermediate sleeve 25*a*, and associated nozzles is positioned and oriented such that its respective centerline 25*c* is bounded by a first boundary plane 28 and a second boundary plane 29. In other words, each centerline 25*c* does not intersect or cross its respective boundary planes 28, 29 along its path from its respective nozzle to the borehole bottom 7. Boundary planes 28, 29 are circumferentially positioned between each pair of adjacent legs 19. More specifically, each boundary plane 28, 29 is parallel to and passes through bit axis 11, and is oriented at a boundary angle $\beta_1$, $\beta_2$, respectively, relative to a reference plane 27 that is parallel to and passes through bit axis 11, and is circumferentially disposed at the midpoint between adjacent legs 19. Each boundary angle $\beta_1$, $\beta_2$ is preferably less than 30°, and more preferably less than 20°. In most applications, such orientations avoid direct impingement on top of a cone, but still allow for some oblique impingement of fluid flow across the surface of a cone. As a result, the flow impingement pressure will be lower than in conventional bits where fluid is directed to impinge directly on top of the cone shell in the dome region.

Although intermediate sleeve receptacles 25 and intermediate sleeves 25*a* are described as being positioned and oriented to direct drilling fluid toward the cutting elements between each pair of adjacent cones 1-3 to reduce the potential for cone erosion, in other embodiments, the intermediate receptacles (e.g., intermediate sleeve receptacles 25) and associated intermediate sleeves (e.g., intermediate sleeves 25*a*) may be positioned and oriented to direct drilling fluid toward the cone shell surface (e.g., cone shell surface 102*a*, 103*a*, 104*a*) of one of the cone cutters between which the intermediate sleeve is disposed. For example, in cases of extreme bit balling, it may be desirable to increase the hydraulic energy on the cone shell surface to enhance the cone cleaning capabilities. Consequently, the intermediate receptacle, intermediate sleeve, and associated nozzle may be positioned and oriented to direct drilling fluid towards the cone shell surface of one of the adjacent cones in order to disburse significantly more hydraulic energy on that cone shell surface than the adjacent cone shell surface. This offers the potential for increased cone cleaning in applications with extreme balling tendencies. The bit designer may determine how much energy to project onto a given cone shell based on a variety of factors including, without limitation, the abrasiveness of the application, the amount of hydraulic energy that will be expended thru the bit hydraulic system and the number of hours the bit will be run. For such embodiments where some cone shell impingement is desired, each boundary angle $\beta_1$, $\beta_2$ may be as great as 50°.

In general, the column of exiting drilling fluid tends to increase in diameter with distance from the nozzle exit. Thus, one or more of the outer nozzle exits, intermediate nozzle exits, or combinations thereof may be extended or retracted relative to dome 21 through different nozzle designs or sleeve designs as desired to provide a fluid flow that impacts the cutting structure and borehole bottom with a desired amount of energy. For example, one or more sleeves (e.g., intermediate sleeves 25*a*, outer sleeves 35*a*, etc.) may extend from dome 21 to a point below a highest horizontal plane perpendicular to bit axis 11 intersected by the rolling cone cutters (e.g., cones 1-3). Generally, this highest plane is the plane intersected by the gage rows of inserts when positioned in an uppermost position. As shown in FIGS. 8 and 9, outer sleeve 35*a* extends downward from dome 21 to deliver a more concentrated impingement of fluid flow between the cones 1-3 and borehole bottom 7. By positioning the downstream end of a nozzle retention sleeve, and associated nozzle, closer to the borehole bottom, the impact energy of the fluid flow striking the cutting elements and/or the borehole bottom may be increased.

Receptacles 25, 35, sleeves 25*a*, 35*a*, and associated intermediate and outer nozzles, respectively, are positioned and oriented to direct drilling fluid flow between adjacent cones 1-3 in a generally downward direction toward borehole bottom 7, thereby minimizing impingement of cone shells 36. As a result, embodiments described herein offer the potential to provide improved cleaning of both radially inner and radially outer cutter elements, and reduced likelihood of undesirable erosion of cone shells 36. In addition, by reducing impingement of cone shells 36, embodiments described herein also offer the potential to enhance the energy and impact force of the drilling fluid flowing across the cutting elements to borehole bottom 7. To further reduce the potential for cone erosion, in some embodiments, one or more of the intermediate and/or outer nozzles may comprise a diffuser nozzle which diffuses fluid flow exiting the nozzle outlet. The diffuser nozzle reduces the fluid velocity at the nozzle exit which aids in reducing cone shell erosion, and also increases the surface area of cutting elements are cleaned as the fluid flows downward toward the borehole bottom.

Although sleeves 25*a*, 35*a*, and intermediate and outer nozzles, respectively, are described as being positioned and oriented to direct drilling fluid generally downward between adjacent cones 1-3, they may be slightly angled toward one of the two adjacent cones they are disposed between in order to direct drilling fluid closer to the leading side or trailing side of one of the adjacent cones. For instance, in this embodiment, each outer sleeves 35*a* and associated outer nozzles (and hence centerlines 35*c*) are slightly angled toward the leading side of cones 1-3. As used herein, the phrase "leading side" may be used to refer to the side of a cone cutter that is rotating towards and into the formation, whereas the term "trailing side" may be used to refer to the side of a cone cutter that is rotating out of and away from the formation.

Moreover, although each centerline 25*c* is oriented similarly relative to its adjacent journal axes 22, cones 1-3 and associated cutting elements, in other embodiments, the receptacles, sleeves, and/or associated nozzles may be positioned and oriented such that one or more of the drilling fluid trajectory centerlines (e.g., centerlines 25, 35) is oriented differently. This selective positioning and orienting of receptacles, sleeves, and nozzles may be done to provide an optimized flow regime for a given bit design based on a Computational Fluid Dynamic ("CFD") analysis of the fluid flow around the bit and bottomhole during drilling.

Referring now to FIGS. 6 and 11, center sleeve 15*a* and associated center nozzle are preferably positioned and oriented to direct drilling fluid across the radially inner rows of cutting elements (e.g., cutting elements 84) in inner cone region 102 each cone 1-3. To enable cleaning of the radially inner rows of each cone 1-3, the center nozzle is preferably a multistage nozzle capable of forming three exiting streams of drilling fluid—one stream directed towards the inner rows of each cone 1-3. Since the velocity and energy of the streams of drilling fluid exiting a multistage nozzle are relatively low as previously described, a center multistage nozzle may be positioned in center sleeve 15*a* to direct drilling fluid over the top of each cone 1-3 with a reduced risk of cone erosion. In relatively small bits having insufficient space for both intermediate receptacles and a center receptacle (e.g., bits with a diameter less than 13.5), the intermediate receptacles and sleeves may be eliminated, and their cleaning duty taken over by a multistage center nozzle. In such embodiments, the center sleeve and associated multistage center nozzle are preferably positioned and oriented to direct drilling fluid across the cutting elements in the intermediate region of each cone cutter.

The positioning and orientation of nozzle sleeves 15*a*, 25*a*, 35*a* and associated nozzles previously described offers the potential to increase the ROP and durability of bit 10 by enhancing cutting element cleaning and reducing cone shell impingement. Although preferred locations and orientations of the receptacles (e.g., receptacles 15, 25, 35), the sleeves (e.g., sleeves 15*a*, 25*a*, 35*a*), and the associated nozzles may have been described, the optimal positioning and orientation of each receptacle, sleeve, and nozzle may be varied depending on a variety of factors including, without limitation, the bit size, the formation being drilled, and the hydraulic energy provided to the bit from the surface. Thus, it should be appreciated that in other embodiments, the size, location, and orientation of each receptacle, sleeve, and nozzle may be different than that shown.

Embodiments described herein including three outer receptacles (e.g., outer sleeve receptacles 35), three intermediate receptacles (e.g., intermediate sleeve receptacles 25), and a center receptacle (e.g., center receptacle 15) are particularly suited for relatively larger bits with diameters greater than about 16.0 inches, and especially for those bits with diameters greater than about 20.00 inches. Relatively smaller bits inches may not provide sufficient space in the underside for both intermediate receptacles and a center receptacle. Consequently, in such smaller bits, the center receptacle or the intermediate receptacles may be eliminated. Moreover, in relatively smaller bits, fewer than six receptacles and nozzles may provide sufficient cleaning capability for the cutting elements and the borehole bottom. For instance, in smaller bits the surface area of the cutting structure to be cleaned is reduced. However, in relatively larger bits, the surface area of the cutting structure and borehole to be cleaned is increased, and may require additional receptacles and nozzles. Consequently, embodiments described herein including six or more receptacles are preferred for relatively larger bits having diameters greater than about 9.00 inches, and even more preferred for bits having diameters greater than about 15 inches.

Although the embodiment of bit 10 shown in FIG. 9 includes a sleeve 15*a*, 25*a*, 35*a* in each receptacle 15, 25, 35, in other embodiments, one or more receptacles may be bored and then tapped such that a nozzle is directly received by the receptacle, as opposed to a sleeve disposed within the receptacle. Since inclusion of a sleeve generally requires additional space, this option may be particularly suited to smaller bits where space is at a premium.

In some cases, it may be geometrically possible and practical to achieve the preferred drilling fluid trajectory by simply drilling or boring a straight receptacle in the dome region in alignment with the desired drilling fluid trajectory. With the sleeve coaxially disposed in the receptacle, the drilling fluid will flow through the sleeve and exit the nozzle disposed in the sleeve in a direction substantially aligned with the desired trajectory. For example, in this embodiment, receptacle 25 is a straight bore through dome 21 within which a straight cylindrical sleeve 25*a* is disposed. Receptacle 25 and sleeve 25*a* share a common central axis 25' that is aligned with the desired drilling fluid trajectory centerline 25*c*. Consequently, drilling fluid flowing through sleeve 25*a* and the nozzle disposed in the downstream end of sleeve 25*a* will exit along centerline 25*c*. However, in other cases, it may be geometrically impossible and/or impractical to bore the nozzle receptacle in alignment with the desired drilling fluid exiting trajectory. For example, in this embodiment, due to space limitations proximal the periphery of dome 21, outer sleeve receptacle 35 is bored through dome 21 along a centerline 35' that is out of alignment with the desired drilling fluid trajectory centerline 35*c*. Thus, the direction of drilling fluid flowing from plenum 24 through outer sleeve receptacle 35 must be adjusted to achieve the desired centerline 35*c*. Such adjustment in the direction of the drilling fluid may be achieved by the sleeve as described in U.S. patent application Ser. No. 12/104,856 filed Apr. 17, 2008, and entitled "Rock Bit with Vectored Hydraulic Nozzle Sleeves", which is hereby incorporated herein by reference in its entirety.

The portions of the cone shell (e.g., cone shell 36) proximal the cutting elements impinged by the drilling fluid exiting a nozzle may be coated with an abrasion resistant material to increase erosion resistance. This erosion, referred to as cone shell erosion, typically occurs in areas near the paths of mud or fluid emitted from the nozzles of the bit or in areas proximate the borehole surfaces struck by the mud or fluid flow. In the areas near the flow, the mud or fluid may strike or may be deflected onto the cones and cutters resulting in their erosion. A typical erosion resistant coating would comprise a conventional hardfacing with tungsten carbide particles or a coating of tungsten carbide. These coatings can be applied via a high velocity implantation method such as the Super D-Gun method. To reduce erosion, the cutting elements proximate a fluid flow may also be fabricated of a material with enhanced wear resistance properties.

Figure 14:
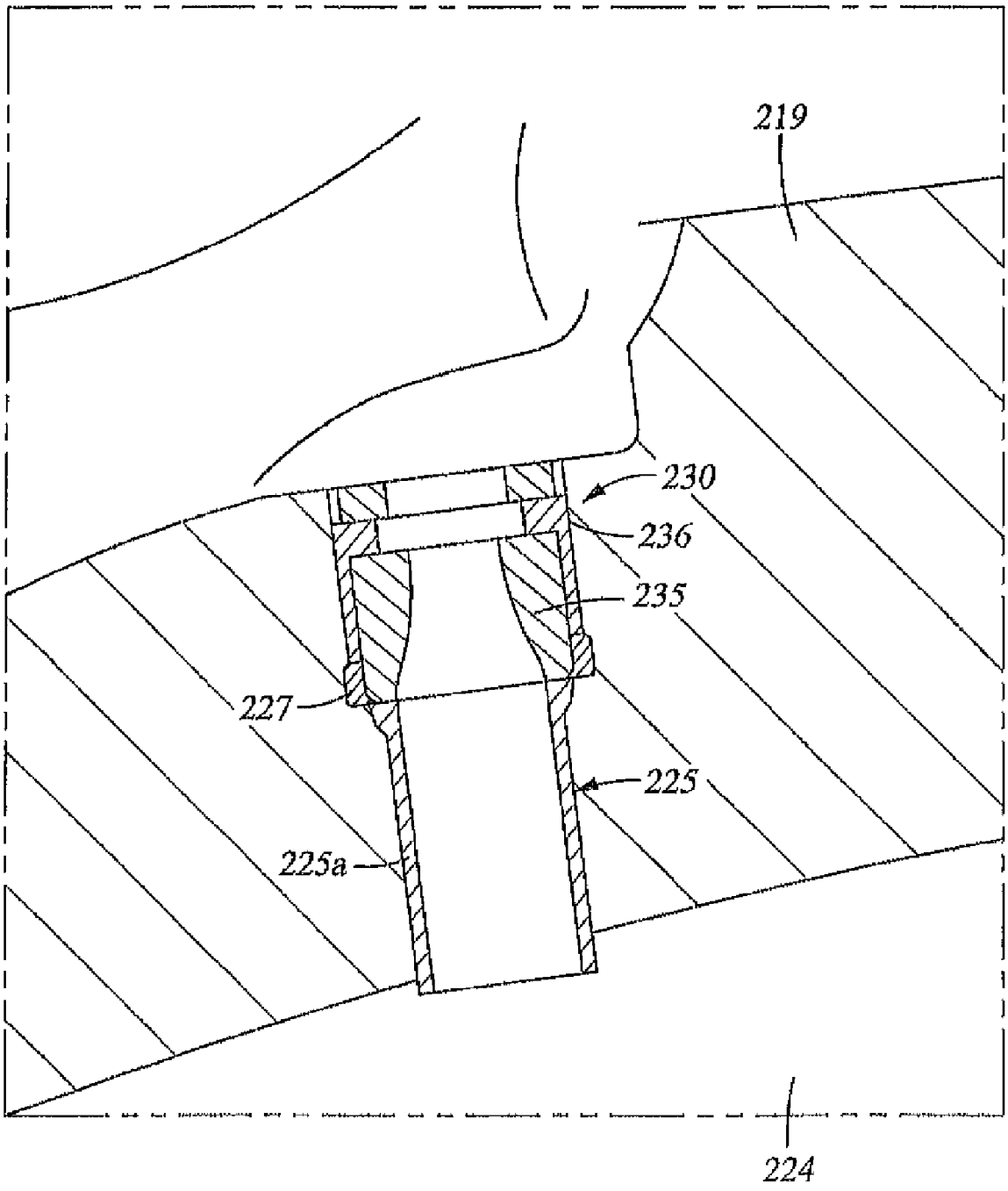
FIG. 14 is a partial cross-sectional view of an embodiment of a leg with an intermediate bore including a wear sleeve.

Erosion of the leg forging itself may also occur as the abrasive drilling fluid flows at relatively high velocities from the plenum through the receptacles. Consequently, an erosion resistant wear sleeve may be disposed in one or more of the outer and/or intermediate receptacles. For example, referring now to FIG. 14, one leg 219 of a rolling cone bit is shown. Leg 219 includes an intermediate receptacle 225. A tungsten carbide wear sleeve 225*a* is fixed in receptacle 225 and provides erosion protection to the steel leg forging. Wear sleeve 225*a* may be fixed in receptacle 225 by any suitable means including, without limitation, by welding, gluing, threading, with the use of a snap ring or combinations thereof. In this embodiment, wear sleeve 225*a* extends from the plenum 224 to an O-ring gland 227 where it abuts a nozzle assembly 230. Nozzle assembly 230 includes a wear resistant cemented tungsten carbide nozzle 235 and a steel retaining ring 236 which is threaded into forging 110. Although retaining ring 236 is used in this embodiment to secure nozzle 235 within receptacle 225, in general, any suitable means may be used to install nozzle 235 including, without limitation, snap rings, nail retention, brazing, or combinations thereof.

The use of erosion resistant wear sleeve 225*a* is particularly useful in relatively smaller bits where larger nozzle bores are prohibitive due to the lack of available space in the smaller leg forgings. In general, the inclusion of wear sleeve 225*a* allows for higher drilling fluid flow rates through receptacle 225 nozzle than would be possible with steel due to the risk of internal erosion of the steel leg forging.

In the manufacture of a leg as shown in FIGS. 7 and 8, generally the larger the bit, the longer the milling tool needed to reach the desired location for the placement of the intermediate receptacles for the ultimate placement of the intermediate nozzles. Conventionally, milling receptacles and bores in the interior of dome 21 proximal a journal (e.g., in the dome region) has been avoided for several reasons including the increased risk of damaging the journal during milling, the time required to carefully mill close to a journal, and the longer milling tools required to reach desired locations. In general, the longer the milling tools used, the greater the vibrations and chatter experienced during milling, and the more difficult to achieve the desired tolerances for the bores drilled. However, embodiments described herein offer the potential to reduce such problems by using a weld-in sleeves that may be machined to desired tolerances and then welded or otherwise attached to the receptacles. The jet or nozzle is then disposed in the downstream end of the sleeve. An O-ring may be provided to seal between the sleeve and nozzle. The use of a weld-in sleeve is further discussed in U.S. Pat. No. 5,538,093, which is assigned to the assignee of the present invention and incorporated herein by reference.

Embodiments described herein offer the potential for dome side installation and/or removal of the intermediate nozzles using a suitable tool such as a tool comprising a T-wrench handle, extension, universal joint, and wrench head. This tool also permits removal of the nozzle from the bit and replacement of a different nozzle size or type as desired. The ability to mill and install nozzles from the underside of the bit permits increased flexibility in the location and orientation of nozzles in the intermediate region of the underside as compared to nozzles placed in receptacles milled through the pin side of the bit. Milling and installation through the pin side of the bit is generally limited because of the limited line of sight provided in the interior of the bit and the limited space available for maneuvering a traditional (straight) nozzle wrench for installing nozzles. Because of these limitations orientation of nozzle bores located in the intermediate region of the underside of conventional bits has been largely limited to orientations that result in direct impingement of fluid flow on top of the cones. While installation from a dome side of the bit has been discussed, it should be appreciated that in other embodiments the intermediate nozzles may be installed from the pin end.

Although the embodiments described herein were described as having three rolling cones cutters 1-3, the principles described may also be applied to a bit having any number of cones (e.g., 1, 2, 4, etc.). Further, although three intermediate sleeve receptacles 25 and three outer sleeve receptacles 35 are shown in the embodiments described herein, in other embodiments any suitable number of receptacles and associated nozzles. For example, in one embodiment, a three cone bit may include two intermediate receptacles and associated nozzles and three outer receptacles and nozzles, with one intermediate receptacle and outer receptacle disposed between two pair of adjacent cones, and only an outer receptacle disposed between the third pair of adjacent cones. It is believed that this configuration may result in sufficient cleaning of the cones in many applications because the intermediate and outer nozzles between two pairs of adjacent cones may be arranged to clean opposite cones and the single outer nozzle between the third pair of adjacent cones may be arranged to clean between the intermesh of the third pair of cones and may include a diffuser nozzle such that cutting structure cleaning is provided one each of the cones near gage and intermesh regions of the cones. In such an embodiment, and center nozzle may also be added for enhanced cone cleaning near the nose portions of the cones.

As previously described, the placement and directionality of the receptacles and associated nozzles, as well as the nozzle sizing and nozzle extension, can significantly affect the rate of penetration for the drill bit and bit life. The optimal placement, directionality and sizing of each nozzle can change depending on the bit size, the formation type being drilled, and the hydraulic energy provided to the bit from the surface. Thus, it should be appreciated that in other embodiments, nozzle sizes, locations, orientations, and extensions may be different than that shown for embodiments herein to best suit drilling requirements for a particular application.

EXAMPLES

The following examples are given as to particular aspects of the embodiments described herein and to demonstrate the practice and advantages thereof. It is understood that the examples are given by way of illustration and are not intended to limit the specification of the claims to follow in any manner.

Example 1

Cone Shell Wall Shear Stress as a Function of Radial Position

Figure 15:
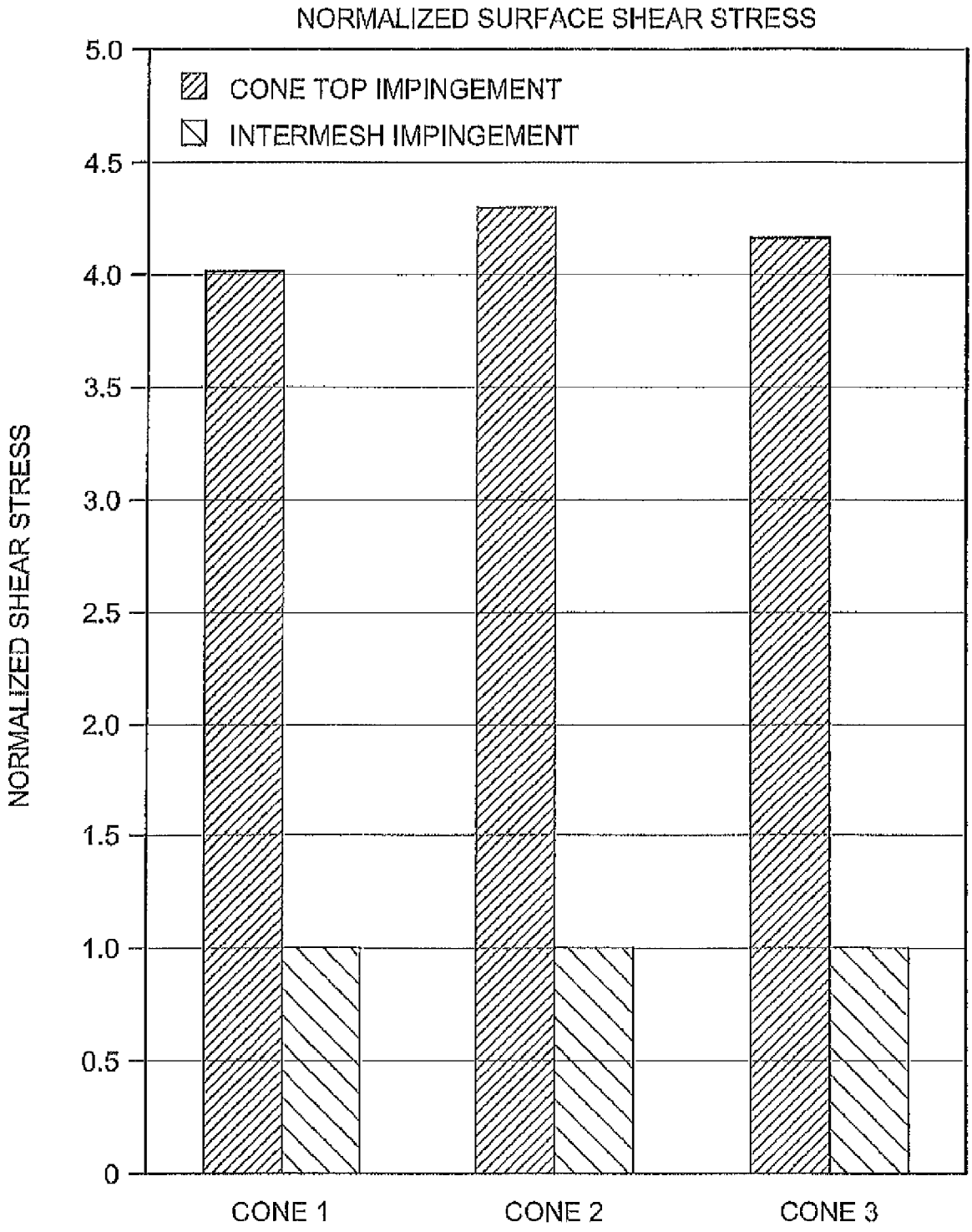
FIG. 15 is a plot illustrating a comparison of the normalized wall shear stress experienced by each cone of a bit made in accordance with the principles described herein and each cone of a conventional bit with drilling fluid trajectories that impinge the top of each cone shell.

A computational study was performed to compare the energy levels on the surface of each cone of a conventional three-cone bit and an embodiment of a three-cone bit in accordance with the principles herein. for two case studies. The conventional bit was a 16.00 inch three-cone bit having an intermediate nozzle positioned and oriented to direct drilling fluid on the top of each cone. The bit in accordance with the principles described herein was also a 16.00 inch bit, however, an intermediate nozzle was positioned and oriented to direct drilling fluid through the intermesh in between each pair of adjacent cones. The intermediate nozzles in both bits were of the same size and type. To determine the energy levels on the cone surfaces, the shear stress was evaluated in the area where the high velocity drilling fluid had the most direct and greatest impact on the cone shell surface. The maximum shear stresses on the cone surface for each cone was measured for both bits and then normalized. Normalizing was performed on a cone-by-cone basis by dividing the maximum shear stress measured for each cone by the maximum shear stress measured for the analogous cone of the intermesh impingement bit (i.e., the bit in accordance with the principles described herein) Thus, the normalized surface shear stress experienced by each cone of the intermesh impingement bit always had a value of one. As shown in FIG. 15, the surface shear stress experienced by each cone of the conventional bit was about 400% greater than that experienced by the intermesh impingement bit.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is

1. A drill bit for drilling through an earthen formation to form a borehole with a radius R, a bottom and a sidewall, the drill bit having a full gage diameter with the radius R and comprising:

a bit body having a central bit axis and including a pin end, an internal plenum, and a dome side generally opposite the pin end;

wherein the dome side includes a central dome region extending from the bit axis to about 10% of the radius R, an annular intermediate dome region extending from the central region to about 50% of the radius R, and an annular outer dome region extending from the intermediate region to about 90% of the radius R;

a plurality of intermediate receptacles, wherein each intermediate receptacle has a central axis and extends through the intermediate dome region to the plenum;

a first and a second rolling cone, each cone being mounted to the bit body and adapted for rotation about a different cone axis;

wherein each cone comprises a nose proximal the bit axis, a generally planar backface distal the bit axis, an inner cone region extending axially relative to the cone axis from the nose to an intermediate cone region, and an outer cone region extending axially relative to the cone axis from the backface to the intermediate region;

wherein a plurality of cutting elements are mounted to the inner region, the intermediate region, and the outer region of each cone, wherein the cutting elements mounted to the inner cone region of each cone are positioned to contact the borehole bottom between the bit axis and about 25% of the radius R, the cutting elements mounted to the intermediate cone region of each cone are positioned to contact the borehole bottom between about 25% and 75% of the radius R, and the cutting elements mounted to the outer cone region of each cone are positioned to contact the borehole bottom between about 75% and 100% of the radius R;

wherein a projection of the central axis of each intermediate receptacle passes between the intermediate region of the first cone and the intermediate region of the second cone; and an intermediate nozzle disposed within each of the intermediate receptacles, wherein each intermediate nozzle has an orifice with a diameter Di;

wherein the diameter Di of each intermediate nozzle is selected such that 20% to 55% of the total volumetric flow of drilling fluid through the plenum passes through the orifices of the intermediate nozzles.

2. The drill bit of claim 1 wherein the plurality of cutting elements of the inner region are non-intermeshing cutting elements;

wherein the plurality of cutting elements of the outer region are non-intermeshing cutting elements; and wherein the plurality of cutting elements of the intermediate region are intermeshing cutting elements.

3. The drill bit of claim 1 wherein each intermediate receptacle is disposed at a radius $R_i$ measured perpendicularly from the bit axis to the center of the downstream end of the intermediate receptacle at the dome side, wherein the radius $R_i$ is between 15% and 45% of the radius R.

4. The drill bit of claim 3 wherein the radius $R_i$ is between 25% and 30% of the radius R.

5. The drill bit of claim 3 further comprising an intermediate nozzle retention sleeve coaxially disposed in the intermediate receptacle, wherein the intermediate nozzle retention sleeve has an upstream end in fluid communication with the plenum and a downstream end adapted to receive the intermediate nozzle.

6. The drill bit of claim 5 further comprising:

an outer receptacle extending through the outer dome region to the plenum;

an outer nozzle retention sleeve coaxially disposed in the outer receptacle, wherein the outer nozzle retention sleeve has an upstream end in fluid communication with the plenum, a downstream end adapted to receive an outer nozzle, and a through passage extending between the upstream end and the downstream end, wherein the through passage in the downstream end has a central downstream axis;

wherein a projection of the downstream axis passes between the outer cone region of the first cone and the outer cone region of the second cone.

7. The drill bit of claim 6 wherein the outer receptacle is disposed at a radius $R_o$ measured perpendicularly from the bit axis to the center of the downstream end of the outer receptacle at the dome side, wherein the radius $R_o$ is between 60% and 90% of the radius R.

8. The drill bit of claim 7 wherein the radius $R_o$ is between 60% and 80% of the radius R.

9. The drill bit of claim 6 further comprising:

a central receptacle through the central dome region to the plenum; and a central nozzle disposed within the central receptacle.

10. The drill bit of claim 1 wherein the intermediate receptacle is circumferentially disposed between the cone axis of the first cone and the cone axis of the second cone, wherein a first distance A is the shortest distance measured between the cone axis of the first cone and the projection of the central axis of the intermediate receptacle, wherein a second distance B is the shortest distance measured between the cone axis of the second cone and the projection of the central axis of the intermediate receptacle, and wherein the ratio of the first distance A to the second distance B is between 0.5 and 2.0.

11. The drill bit of claim 1 wherein the bit body further comprises a first leg and a second leg circumferentially spaced from the first leg, each leg including a journal, wherein the first cone is mounted to the journal of the first leg and the second cone is mounted to the journal of the second leg;

wherein a reference plane parallel to and passing through the bit axis is positioned at the circumferential midpoint between the first leg and the second leg;

wherein a first boundary plane parallel to and passing through the bit axis is oriented at a boundary angle $\beta_1$ relative to one side of the reference plane;

wherein a second boundary plane parallel to and passing through the bit axis is oriented at a boundary angle $\beta_2$ relative to the opposite side of the reference plane;

wherein the projection of the central axis of the intermediate receptacle is bounded by the first boundary plane and the second boundary plane between the dome side and the borehole bottom; and wherein the first boundary angle $\beta_1$ and the second boundary angle $\beta_2$ are each less than 30°.

12. The drill bit of claim 11 wherein the first boundary angle $\beta_1$ and the second boundary angle $\beta_2$ are each less than 20°.

13. The drill bit of claim 1 wherein the projection of the central axis of the intermediate receptacle does not intersect the first cone and does not intersect the second cone.

14. The drill bit of claim 1 wherein each cone has a leading side and a trailing side, and wherein the projection of the central axis of the intermediate receptacle is skewed towards the leading side of the first cone cutter and away from the trailing side of the second cone cutter.

15. The drill bit of claim 1 further comprising a wear resistant sleeve coaxially disposed in the intermediate receptacle, wherein the wear resistant sleeve is made from cemented tungsten carbide.

16. A drill bit according to claim 1, further comprising a plurality of outer receptacles, wherein each outer receptacle has a central axis and extends through the outer dome region to the plenum.

17. A drill bit according to claim 16, further comprising an outer nozzle disposed in each of the outer receptacles.

18. A drill bit according to claim 17, wherein each outer nozzle and each intermediate nozzle is a diffuser nozzle.

19. A drill bit according to claim 17, wherein each outer nozzle has an orifice with a diameter Do, and wherein the diameter Do of each outer nozzle is selected such that 45% to 80% of the total volumetric flow of drilling fluid through the plenum passes through the orifices of the outer nozzles.

20. A drill bit according to claim 1, further comprising a central receptacle having a central axis and extending through the central dome region to the plenum.

21. A drill bit according to claim 20, further comprising a center nozzle disposed in the central receptacle.

22. A drill bit according to claim 21, wherein the center nozzle is a multistage nozzle.

23. A drill bit according to claim 21, wherein the center nozzle has an orifice with a diameter Dc, and wherein the diameter Dc of the center nozzle is selected such that at least 10% of the total volumetric flow of drilling fluid through the plenum passes through the orifice of the center nozzle.

24. A drill bit according to claim 19, wherein the diameter Di of each intermediate nozzle and the diameter Do of each outer nozzle are selected such that 30% to 45% of the total volumetric flow of drilling fluid through the plenum passes through the orifices of the intermediate nozzles and 55% to 70% of the total volumetric flow of drilling fluid through the plenum passes through the orifices of the outer nozzles.

25. A drill bit for drilling through an earthen formation to form a borehole with a radius R, a bottom and a sidewall, the drill bit having a full gage diameter with the radius R and comprising:

a bit body having a central bit axis and including a pin end, an internal plenum, a dome side generally opposite the pin end, a first leg, and a second leg circumferentially spaced from the first leg, each leg including a journal;

wherein the dome side includes a central dome region extending from the bit axis to about 10% of the radius R, an annular intermediate dome region extending from the central region to about 50% of the radius R, and an annular outer dome region extending from the intermediate region to about 90% of the radius R;

an intermediate receptacle having a central axis and extending through the intermediate dome region to the plenum;

a first rolling cone mounted to the journal of the first leg and adapted for rotation about a first cone axis;

a second rolling cone mounted to the journal of the second leg and adapted for rotation about a second cone axis;

wherein a reference plane parallel to and passing through the bit axis is positioned at the circumferential midpoint between the first leg and the second leg;

wherein a first boundary plane parallel to and passing through the bit axis is oriented at a boundary angle $\beta_1$ relative to the reference plane;

wherein a second boundary plane parallel to and passing through the bit axis is oriented at a boundary angle $\beta_2$ relative to the reference plane;

wherein the first boundary plane and the second boundary plane are disposed on opposite sides of the reference plane;

wherein the first boundary angle $\beta_1$ and the second boundary angle $\beta_2$ are each less than 30°;

wherein a projection of the central axis of the intermediate receptacle is circumferentially bounded by the first boundary plane and the second boundary plane between the dome side and the borehole bottom, and wherein the projection is angled toward the first rolling cone, has an upstream end at the dome side and a downstream end at the borehole bottom, the upstream end of the projection being positioned between the reference plane and the first boundary plane, and the downstream end being positioned between the reference plane and the second boundary plane.

26. The drill bit of claim 25 wherein the first boundary angle $\beta_1$ and the second boundary angle $\beta_2$ are each less than 20°.

27. The drill bit of claim 25 wherein each cone comprises a nose proximal the bit axis, a generally planar backface distal the bit axis, an inner cone region extending axially relative to the cone axis from the nose to an intermediate cone region, and an outer cone region extending axially relative to the cone axis from the backface to the intermediate region;

wherein a plurality of non-intermeshing cutting elements are mounted to the inner region, a plurality of intermeshing cutting elements are mounted to the intermediate region, and a plurality of non-intermeshing cutting elements are mounted to the outer region of each cone;

wherein the non-intermeshing cutting elements mounted to the inner cone region of each cone are positioned to contact the borehole bottom between the bit axis and about 25% of the radius R, the intermeshing cutting elements mounted to the intermediate cone region of each cone are positioned to contact the borehole bottom between about 25% and 75% of the radius R, and the non-intermeshing cutting elements mounted to the outer cone region of each cone are positioned to contact the borehole bottom between about 75% and 100% of the radius R;

wherein the projection of the central axis of the intermediate receptacle impinges the intermediate cone region of the first cone.

28. The drill bit of claim 25 wherein each cone comprises a nose proximal the bit axis, a generally planar backface distal the bit axis, an inner cone region extending axially relative to the cone axis from the nose to an intermediate cone region, and an outer cone region extending axially relative to the cone axis from the backface to the intermediate region;

wherein a plurality of non-intermeshing cutting elements are mounted to the inner region, a plurality of intermeshing cutting elements are mounted to the intermediate region, and a plurality of non-intermeshing cutting elements are mounted to the outer region of each cone;

wherein the non-intermeshing cutting elements mounted to the inner cone region of each cone are positioned to contact the borehole bottom between the bit axis and about 25% of the radius R, the intermeshing cutting elements mounted to the intermediate cone region of each cone are positioned to contact the borehole bottom between about 25% and 75% of the radius R, and the non-intermeshing cutting elements mounted to the outer cone region of each cone are positioned to contact the borehole bottom between about 75% and 100% of the radius R;

wherein the projection of the central axis of the intermediate receptacle passes between the intermediate cone region of the first cone and the intermediate cone region of the second cone; and wherein the projection of the central axis of the intermediate receptacle does not intersect the first cone and does not intersect the second cone.

29. The drill bit of claim 25 wherein the intermediate receptacle is disposed at a radius $R_i$ measured perpendicularly from the bit axis to the center of the downstream end of the intermediate receptacle at the dome side, wherein the radius $R_i$ is between 15% and 45% of the radius R.

30. The drill bit of claim 25 further comprising an intermediate nozzle retention sleeve coaxially disposed in the intermediate receptacle, wherein the intermediate nozzle retention sleeve has an upstream end in fluid communication with the plenum and a downstream end adapted to receive an intermediate nozzle.

31. The drill bit of claim 25 wherein the intermediate receptacle is circumferentially disposed between the cone axis of the first cone and the cone axis of the second cone, wherein a first distance A is the shortest distance measured between the cone axis of the first cone and the projection of the central axis of the intermediate receptacle, wherein a second distance B is the shortest distance measured between the cone axis of the second cone and the projection of the central axis of the intermediate receptacle, and wherein the ratio of the first distance A to the second distance B is between 0.5 and 2.0.

32. A drill bit for drilling an earthen formation to form a borehole with a radius R comprising:

a bit body having a central axis and a dome side;

wherein the dome side includes a central dome region extending from the bit axis to about 10% of the radius R, an annular intermediate dome region extending from the central region to about 50% of the radius R, and an annular outer dome region extending from the intermediate region to about 90% of the radius R;

a plurality of rolling cones, each of the cones being mounted to the bit body and adapted for rotation about a different cone axis;

a plurality of intermeshing cutting elements mounted to each of the cones;

a plurality of intermediate receptacles in the bit body, wherein each intermediate receptacle has a central axis and extends through the intermediate dome region to the plenum;

wherein one intermediate receptacle is circumferentially positioned between the cone axes of each pair of adjacent cones;

wherein a projection of the central axis of each intermediate receptacle intersects the intermeshing cutting elements between each pair of adjacent cones.

33. The drill bit of claim 32 further comprising:

a plurality of outer receptacles in the bit body, wherein each outer receptacle extends through the outer dome region to the plenum, and wherein one outer receptacle is circumferentially positioned between the cone axes of each pair of adjacent cones.

34. The drill bit of claim 33 wherein each intermediate receptacle is disposed at a radius $R_i$ measured perpendicularly from the bit axis to the center of the downstream end of the intermediate receptacle at the dome side;

wherein each outer receptacle is disposed at a radius $R_o$ measured perpendicularly from the bit axis to the center of the downstream end of the outer receptacle at the dome side;

wherein the radius $R_i$ is between 15% and 45% of the radius R; and wherein the radius $R_o$ is between 60% and 90% of the radius R.

35. The drill bit of claim 34 wherein the radius $R_i$ is between 25% and 30% of the radius R and the radius $R_o$ is between 60% and 80% of the radius R.

36. The drill bit of claim 34 further comprising:

a plurality of intermediate nozzle retention sleeves, wherein one intermediate nozzle retention sleeve is coaxially disposed in each intermediate receptacle, and wherein each intermediate nozzle retention sleeve has an upstream end in fluid communication with the plenum and a downstream end adapted to receive an intermediate nozzle; and a plurality of outer nozzle retention sleeves, wherein one outer nozzle retention sleeve is coaxially disposed in each outer receptacle, and wherein the outer nozzle retention sleeve has an upstream end in fluid communication with the plenum, a downstream end having a downstream axis and adapted to receive an outer nozzle, and a through passage extending between the upstream end and the downstream end.

* * * * *